US008066495B2

(12) United States Patent
Sekiguchi et al.

(10) Patent No.: US 8,066,495 B2
(45) Date of Patent: Nov. 29, 2011

(54) TURBO VACUUM PUMP AND SEMICONDUCTOR MANUFACTURING APPARATUS HAVING THE SAME

(75) Inventors: Shinichi Sekiguchi, Tokyo (JP); Hiroaki Ogamino, Tokyo (JP); Hiroyasu Kawashima, Tokyo (JP)

(73) Assignee: Ebara Corporation, Tokyo (JP)

( * ) Notice: Subject to any disclaimer, the term of this patent is extended or adjusted under 35 U.S.C. 154(b) by 36 days.

(21) Appl. No.: 12/613,854

(22) Filed: Nov. 6, 2009

(65) Prior Publication Data

US 2010/0047096 A1 Feb. 25, 2010

Related U.S. Application Data

(63) Continuation of application No. 10/921,197, filed on Aug. 19, 2004, now Pat. No. 7,717,684.

(30) Foreign Application Priority Data

Aug. 21, 2003 (JP) ..... 2003-297843
Apr. 21, 2004 (JP) ..... 2004-126048

(51) Int. Cl.
*F04B 35/04* (2006.01)

(52) U.S. Cl. ..... 417/423.4; 417/423.12; 417/324

(58) Field of Classification Search ..... 417/423.4, 417/423.12, 324
See application file for complete search history.

(56) References Cited

U.S. PATENT DOCUMENTS

| | | | | |
|---|---|---|---|---|
| 4,116,592 | A * | 9/1978 | Cherny et al. | 417/423.4 |
| 4,140,441 | A * | 2/1979 | Patterson | 417/423.4 |
| 4,668,160 | A | 5/1987 | Mase et al. | |
| 5,197,861 | A | 3/1993 | Maruyama et al. | |
| 5,238,362 | A | 8/1993 | Casaro et al. | |
| 6,071,092 | A | 6/2000 | Casaro et al. | |
| 6,375,413 | B1 | 4/2002 | Stones | |
| 6,514,348 | B2 | 2/2003 | Miyamoto | |
| 6,599,091 | B2 | 7/2003 | Nagle | |
| 6,705,844 | B2 | 3/2004 | Englander | |
| 6,824,357 | B2 * | 11/2004 | Stanzel | 415/175 |
| 2004/0258544 | A1 | 12/2004 | Hokkirigawa et al. | |
| 2005/0025640 | A1 | 2/2005 | Sekiguchi et al. | |

FOREIGN PATENT DOCUMENTS

JP 02-019694 A 1/1990

* cited by examiner

*Primary Examiner* — Charles Freay
*Assistant Examiner* — Patrick Hamo
(74) *Attorney, Agent, or Firm* — Westerman, Hattori, Daniels & Adrian, LLP

(57) ABSTRACT

A turbo vacuum pump is suitable for evacuating a corrosive process gas or evacuating a gas containing reaction products. The turbo vacuum pump includes a casing having an intake port, a pump section comprising rotor blades and stator blades housed in the casing, bearings for supporting the rotor blades, a motor for rotating the rotor blades; and a rotating shaft comprising a first rotating shaft to which the rotor blades are attached, and a second rotating shaft to which a motor rotor of the motor is attached.

3 Claims, 17 Drawing Sheets

TURBO VACUUM PUMP AND SEMICONDUCTOR MANUFACTURING APPARATUS HAVING THE SAME

CROSS REFERENCE TO RELATED APPLICATIONS

This application is a continuation of U.S. patent application Ser. No. 10/921,197, filed on Aug. 19, 2004.

BACKGROUND OF THE INVENTION

1. Field of the Invention

The present invention relates to a turbo vacuum pump for evacuating a gas, and more particularly to a turbo vacuum pump suitable for evacuating a corrosive process gas or evacuating a gas containing reaction products. The present invention also relates to a semiconductor manufacturing apparatus having such a turbo vacuum pump.

2. Description of the Related Art

FIG. 16 of the accompanying drawings shows a conventional turbo vacuum pump disclosed in Japanese Patent Publication No. 2680156. As shown in FIG. 16, the conventional turbo vacuum pump comprises a casing 11 having an intake port 11A and an exhaust port 11B, a rotating shaft 12 provided in the casing 11 and rotatably supported by bearings 16, and a centrifugal compression pumping section 13 and a peripheral compression pumping section 14 arranged successively in the casing 11 from the intake port side (the side of the intake port 11A) to the exhaust port side (the side of the exhaust port 11B). The centrifugal compression pumping section 13 comprises open impellers 13A fixed to the rotating shaft 12 and stationary circular disks 13B which are alternately disposed in an axial direction of the pump. The peripheral compression pumping section 14 comprises impellers 14A fixed to the rotating shaft 12 and stationary circular disks 14B which are alternately disposed in the axial direction of the pump. The rotating shaft 12 is rotated by a motor 15 coupled to the rotating shaft 12.

In the case where a corrosive gas is evacuated by the conventional turbo vacuum pump shown in FIG. 16, the casing 11, the rotating shaft 12, and the pumping sections 13 and 14 are required to have corrosion resistance. Further, in the case where a gas containing reaction products is evacuated by the conventional turbo vacuum pump, in order to prevent the reaction products from being deposited in the pumping sections 13 and 14, it is necessary to keep an evacuation passage at a high temperature. Therefore, it is desirable that the casing 11, the rotating shaft 12 and the pumping sections 13 and 14 are composed of materials having corrosion resistance and low coefficient of thermal expansion so that dimensional change caused by temperature change is small. Further, if the rotating shaft 12 is composed of a material having high strength and high Young's modulus, then high-speed rotation of the rotating shaft 12 can be easily achieved to enhance evacuation performance of the vacuum pump. Furthermore, it is desirable that the rotating shaft 12 is composed of a ferromagnetic material to improve output characteristics of the motor 15.

However, because very few materials have the characteristics of corrosion resistance, low coefficient of thermal expansion, high strength, high Young's modulus, and ferromagnetism all together, materials for the rotating shaft 12 must be chosen depending on its use or at the sacrifice of any of the characteristics. For example, as a material used frequently for the rotating shaft, there is Fe—Ni alloy such as Niresist cast iron. The characteristics of Fe—Ni alloy are corrosion resistance, low coefficient of thermal expansion, and ferromagnetism, but the Young's modulus of the Fe—Ni alloy is about 130 GPa and is smaller than that of a general steel material which is 206 GPa. Therefore, the critical speed of the rotor becomes low, and hence it is difficult to achieve high-speed rotation of the rotor. Thus, the rotational speed of the rotor is made lower at the sacrifice of evacuation performance of the vacuum pump. Alternatively, the diameter of the rotating shaft is made larger to achieve high-speed rotation of the rotor, thus failing to make the pump small-sized and lightweight.

Next, an example of a conventional semiconductor manufacturing apparatus which incorporates a vacuum pump will be described with reference to FIG. 17. As shown in FIG. 17, in a conventional semiconductor manufacturing apparatus 81, a vacuum evacuation system is constructed by a vacuum pump 83 provided outside of the apparatus and a piping 84 connecting a vacuum chamber 82 to the vacuum pump 83. However, in the case where a large amount of gas is flowed during a manufacturing process, or a pressure in the vacuum chamber is lowered, this construction frequently causes a problem of conductance of the piping 84. In order to solve this problem, the diameter of the piping 84 is made larger and the size of the vacuum pump 83 is made larger, thus increasing an initial cost and enlarging an installation space.

Further, a conductance variable valve 85 is provided in the piping 84, and the opening degree of the conductance variable valve 85 is adjusted so that the pressure of the vacuum chamber 82 is set to a desired value during a manufacturing process. However, the installation of the conductance variable valve 85 causes a lowering of the conductance and complicates the vacuum evacuation system.

FIG. 18 is a schematic view showing a support structure of a rotor in a conventional turbo vacuum pump. As shown in FIG. 18, the turbo vacuum pump comprises a rotor 303 having a stacked and multistage structure. In this vacuum pump, in order to make rotor blades 301 multistage, a hole 304 is formed in a central part of each rotor blade 301, and a rotating shaft 305 is inserted into the hole 304 of each rotor blade 301, whereby the rotor blades 301 are joined together.

However, in the case where the rotating shaft 305 is inserted into the holes 304 of the respective rotor blades 301, a motor 307 is attached to the rotating shaft 305, and a section including the rotor blades 301 and a section including the motor 307 are separated from each other, bearings 306 are disposed in the section including the motor 307. Therefore, the motor 307 is disposed between the bearings 306, and the rotor blades 301 are disposed outwardly of the bearing 306 located near the rotor blades 301, and hence the rotor 303 having the rotating shaft 305 and the rotor blades 301 is supported in such a state that the rotor blades 301 are overhung. That is, the rotor 303 becomes a cantilever structure. Therefore, natural frequency of the rotor 303 is likely to be lowered, and in some cases, it is difficult to achieve high-speed rotation of the rotor 303. Further, because a large load is applied onto the bearing 306 disposed near the rotor blades 301, this bearing 306 is required to be large-sized, resulting in a large-sized pump and an increase of vibrations.

Further, if an increase in evacuation capacity of the vacuum pump makes the rotor blades 301 larger in size and number, then the degree of the overhanging state of the rotor becomes larger to make the above situation worse. Consequently, in order to make the distribution of mass and rigidity appropriate, the rotating shaft 305 is required to be larger in diameter and length, or a balance weight is required to be installed, thus making the vacuum pump larger in size and weight.

SUMMARY OF THE INVENTION

The present invention has been made in view of the above drawbacks. It is therefore a first object of the present invention to provide a turbo vacuum pump for evacuating a corrosive gas or a gas containing reaction products which can be continuously operated over a long period of time by imparting corrosion resistance, low coefficient of thermal expansion, high strength, high Young's modulus, and ferromagnetism to a rotating shaft, and can be small-sized and lightweight by rotating a rotor at a high speed.

A second object of the present invention is to provide a semiconductor manufacturing apparatus having a vacuum chamber which is evacuated by the above turbo vacuum pump disposed near the vacuum chamber.

A third object of the present invention is to provide a turbo vacuum pump having a plurality of rotor blades stacked in an overhanging portion which can be operated at a high speed without an increase of vibrations, and can be small-sized and lightweight without a lowering of pump performance.

In order to achieve the first object of the present invention, there is provided a turbo vacuum pump comprising: a casing having an intake port; a pump section comprising rotor blades and stator blades housed in the casing; bearings for supporting the rotor blades; a motor for rotating the rotor blades; and a rotating shaft comprising a first rotating shaft to which the rotor blades are attached, and a second rotating shaft to which a motor rotor of the motor is attached.

In a preferred aspect of the present invention, the turbo vacuum pump further comprises a shaft fastening portion for coupling the first rotating shaft and the second rotating shaft.

According to the present invention, the rotating shaft is divided into a first portion (first rotating shaft) to which rotor blades are attached and a second portion (second rotating shaft) to which at least a motor rotor of a motor is attached, and hence a material having the most requisite characteristic can be selected for respective portions of the rotating shaft. Thus, the rotating shaft having corrosion resistance, low coefficient of thermal expansion, high strength, high Young's modulus, and ferromagnetism can be constructed.

For example, since the first rotating shaft is disposed in a pumping section which forms an evacuation passage, the first rotating shaft is composed of a material having corrosion resistance and low coefficient of thermal expansion. Thus, even if the turbo vacuum pump evacuates a corrosive gas, the rotating shaft is not damaged. In the case where a gas containing reaction products is evacuated, deposition of the reaction products is suppressed within the pumping section by keeping the pumping section at a high temperature, but the first rotating shaft is composed of low coefficient of thermal expansion so that dimensional change caused by temperature change can be reduced. Thus, dimensional change of a clearance between the rotor blade and the stator blade which has a great effect on the pump performance can be suppressed as much as possible, and hence the evacuation performance can be stabilized irrespective of temperature variation.

On the other hand, the second rotating shaft is composed of a material having high strength and high Young's modulus because the second rotating shaft has a great effect on axis vibration characteristics of the rotor, and also a ferromagnetic material to improve output characteristics of the motor. In the case where the rotating shaft of the pump is constructed by coupling the first rotating shaft and the second rotating shaft to each other, the pumping section can have corrosion resistance and be operated under a high-temperature condition, and can have good axis vibration characteristics and an increased motor output.

In a preferred aspect of the present invention, the first rotating shaft is composed of a material having at least one of high corrosion resistance and coefficient of linear expansion of $5\times10^{-6}$° C.$^{-1}$ or less.

In a preferred aspect of the present invention, the second rotating shaft is composed of a material having at least one of Young's modulus of 200 GPa or more and ferromagnetism.

In a preferred aspect of the present invention, the turbo vacuum pump further comprises a non-contact sealing mechanism for preventing an exhaust gas existing in the first rotating shaft side from entering the second rotating shaft side.

According to the present invention, since the non-contact sealing mechanism is provided at the location near the coupling portion of the rotating shaft, gas environments around the respective rotating shaft portions can be separated from each other. Therefore, the second rotating shaft can be prevented from contacting a corrosive gas or a gas containing reaction products evacuated by the pump, and hence the second rotating shaft is not required to be composed of a material having corrosion resistance and low coefficient of thermal expansion, and a material having high strength, high Young's modulus and ferromagnetism can be selected for the second rotating shaft. Thus, axis vibration characteristics of the rotor can be improved, and the rotor can be rotated at a high speed. Further, since output characteristics of the motor can be improved, the motor can be small-sized and save energy. Thus, a small-sized and lightweight turbo vacuum pump can be constructed.

In a preferred aspect of the present invention, the turbo vacuum pump further comprises a purge gas port provided at the second rotating shaft side for supplying an inert gas.

With this arrangement, since a stream of an inner gas from the second rotating shaft side to the first rotating shaft side can be easily created, environments around the first rotating shaft and the second rotating shaft can be positively separated from each other.

In a preferred aspect of the present invention, the turbo vacuum pump further comprises a heat insulating structure for providing heat drop between the first rotating shaft side and the second rotating shaft side.

With this arrangement, thermal effect on the motor side from the pumping section having a high temperature can be prevented.

In a preferred aspect of the present invention, part or whole of the first rotating shaft to which the rotor blades are attached has a hollow shaft structure.

As described above, according to the first aspect of the present invention, even if a corrosive gas or a gas containing reaction products is evacuated, the turbo vacuum pump can be continuously operated over a long period of time by imparting corrosion resistance, low coefficient of thermal expansion, high strength, high Young's modulus, and ferromagnetism to the rotating shaft, and can be small-sized and lightweight by rotating the rotor at a high speed.

In order to achieve the second object, according to a second aspect of the present invention, there is provided a semiconductor manufacturing apparatus comprising: a turbo vacuum pump comprising: a casing having an intake port; a pump section comprising rotor blades and stator blades housed in the casing; bearings for supporting the rotor blades; a motor for rotating the rotor blades; and a rotating shaft comprising a first rotating shaft to which the rotor blades are attached, and a second rotating shaft to which a motor rotor of the motor is attached; a vacuum chamber, the turbo vacuum pump being disposed near the vacuum chamber; an evacuation system comprising a backing pump, and a piping connecting an exhaust port of the turbo vacuum pump to the backing pump.

In a preferred aspect of the present invention, the semiconductor manufacturing apparatus further comprises a shaft fastening portion for coupling the first rotating shaft and the second rotating shaft.

In a preferred aspect of the present invention, the first rotating shaft is composed of a material having at least one of high corrosion resistance and coefficient of linear expansion of $5\times10^{-6}$ C.$^{-1}$ or less.

In a preferred aspect of the present invention, the second rotating shaft is composed of a material having at least one of Young's modulus of 200 GPa or more and ferromagnetism.

In a preferred aspect of the present invention, the semiconductor manufacturing apparatus further comprises a non-contact sealing mechanism for preventing an exhaust gas existing in the first rotating shaft side from entering the second rotating shaft side.

In a preferred aspect of the present invention, the semiconductor manufacturing apparatus further comprises a purge gas port provided at the second rotating shaft side for supplying an inert gas.

In a preferred aspect of the present invention, the semiconductor manufacturing apparatus further comprises a heat insulating structure for providing heat drop between the first rotating shaft side and the second rotating shaft side.

In a preferred aspect of the present invention, part or whole of the first rotating shaft to which the rotor blades are attached has a hollow shaft structure.

According to the second aspect of the present invention, a semiconductor manufacturing apparatus which has a vacuum chamber evacuated by the above turbo vacuum pump disposed near the vacuum chamber, and a evacuation system connecting the exhaust port of the turbo vacuum pump to the backing pump by a piping can be constructed.

In a preferred aspect of the present invention, a pressure of the vacuum chamber is kept at a predetermined value by controlling a rotational speed of the turbo vacuum pump. Thus, the evacuation system can be simple in structure.

In order to achieve the above third object, according to a third aspect of the present invention, there is provided a turbo vacuum pump comprising: a rotating shaft rotatably supported by bearings; and a plurality of rotor blades attached to an overhanging portion of the rotating shaft projecting from one of the bearings in such a state that the rotor blades are stacked in an axial direction of the pump; wherein at least a part of the overhanging portion of the rotating shaft has a hollow shaft structure.

With this arrangement, a full or partial overhanging portion of the rotating shaft has a hollow shaft structure, and hence natural frequency of the rotor having the rotating shaft and the rotor blades is hardly lowered and the rotor can be lightweight. Specifically, since the central part of the rotating shaft in a radial direction of the rotating shaft has a lower contribution to bending rigidity, a full or partial overhanging portion of the rotating shaft is formed into a hollow shaft structure, whereby the overhanging portion can be lightweight with little effect on natural frequency. Thus, the rotor can be rotated at a high speed, and the operable range of the rotational speed of the rotor can be broadened. Further, since a bearing load applied to a bearing located at the overhanging portion side can be smaller, the bearing can be small-sized, and thus the turbo vacuum pump can be small-sized. Since the bearing load applied to the bearing can be smaller, vibration of the overhanging portion caused by rotational unbalance can be relatively smaller. Further, since it is not necessary to make a part of the rotating shaft except for the overhanging portion larger in diameter and in length or to provide a balance weight, the turbo vacuum pump can be small-sized and lightweight.

In a preferred aspect of the present invention, the turbo vacuum pump further comprises a motor rotor attached to the rotating shaft between the bearings for rotating the rotating shaft.

With this arrangement, since the motor is attached to the rotating shaft at the position between the two bearings and is disposed coaxially with the rotor blades, the overall apparatus can be small-sized.

In a preferred aspect of the present invention, the turbo vacuum pump further comprises: a plurality of stator blades provided alternately with the rotor blades; and a casing for housing the rotating shaft, a motor including the motor rotor, and the rotor blades, the casing having an intake port for drawing a fluid into the casing and an exhaust port for discharging the fluid to the outside of the casing; wherein the fluid discharged from the final-stage rotor blade flows in a plane perpendicular to a central axis of the rotating shaft until the fluid discharged from the final-stage rotor blade is discharged from the exhaust port.

According to the present invention, a fluid drawn in from the intake port is compressed by the interaction of the rotor blades and the stator blades. Then, the fluid discharged from the final-stage rotor blade flows in a plane perpendicular to a central axis of the rotating shaft until the fluid discharged from the final-stage rotor blade is discharged from the exhaust port, and hence it is not necessary to lengthen the overhanging portion of the rotating shaft. Here, "the fluid flows in a plane" includes "the fluid flows in a certain axial spread which is substantially equal to the length of the outlet width of the final-stage rotor blade".

As described above, according to the third aspect of the present invention, the turbo vacuum pump comprises a rotating shaft rotatably supported by two bearings, and a plurality of rotor blades stacked in an axial direction of the pump and attached to an overhanging portion of the rotating shaft which projects from one of the bearings, and the full or partial overhanging portion of the rotating shaft has a hollow shaft structure. Therefore, the turbo vacuum pump can be operated at a high speed without increasing vibrations, and can be small-sized and lightweight without a lowering of pump performance.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 2A is a front view of the centrifugal drag blade and FIG. 2B is a cross-sectional view of the centrifugal drag blade;

FIG. 3A is a front view of the stator blade and FIG. 3B is a cross-sectional view of the stator blade;

DETAILED DESCRIPTION OF THE PREFERRED EMBODIMENTS

Figure 1:
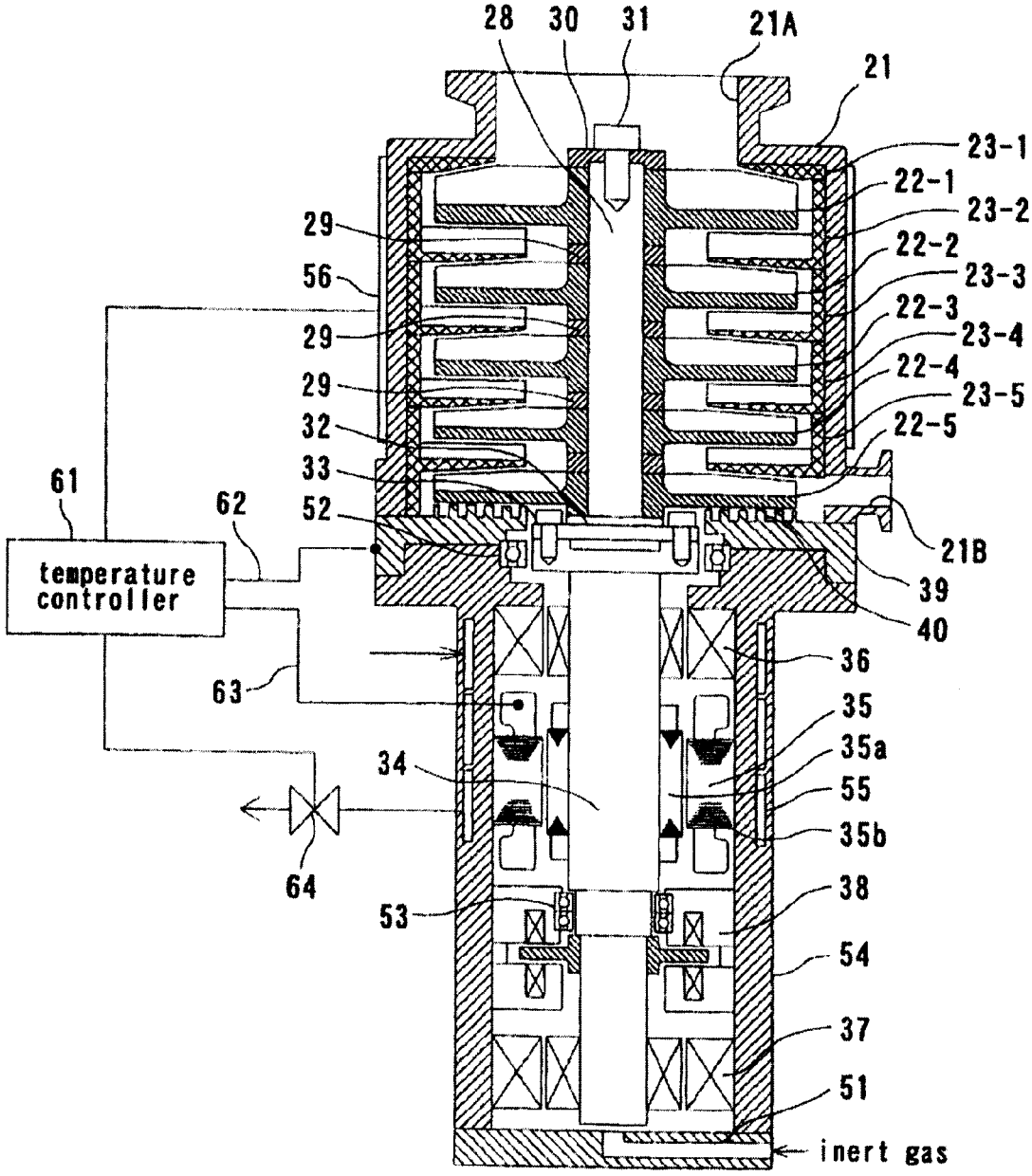
FIG. 1 is a vertical cross-sectional view of a turbo vacuum pump according to a first embodiment of the present invention.

A turbo vacuum pump according to a first embodiment of the present invention will be described below with reference to the drawing. FIG. 1 is a vertical cross-sectional view showing an overall structure of the turbo vacuum pump according to the first embodiment of the present invention. As shown in FIG. 1, the turbo vacuum pump according to the present invention comprises a casing 21 having an intake port 21A and an exhaust port 21B, a plurality of centrifugal drag blades 22-1, 22-2, 22-3, 22-4, and 22-5 (hereafter sometimes referred to simply as centrifugal drag blade 22) provided in the casing 21, and a plurality of stator blades 23-1, 23-2, 23-3, 23-4, and 23-5 (hereafter sometimes referred to simply as stator blade 23) provided in the casing 21.

Figure 2A:
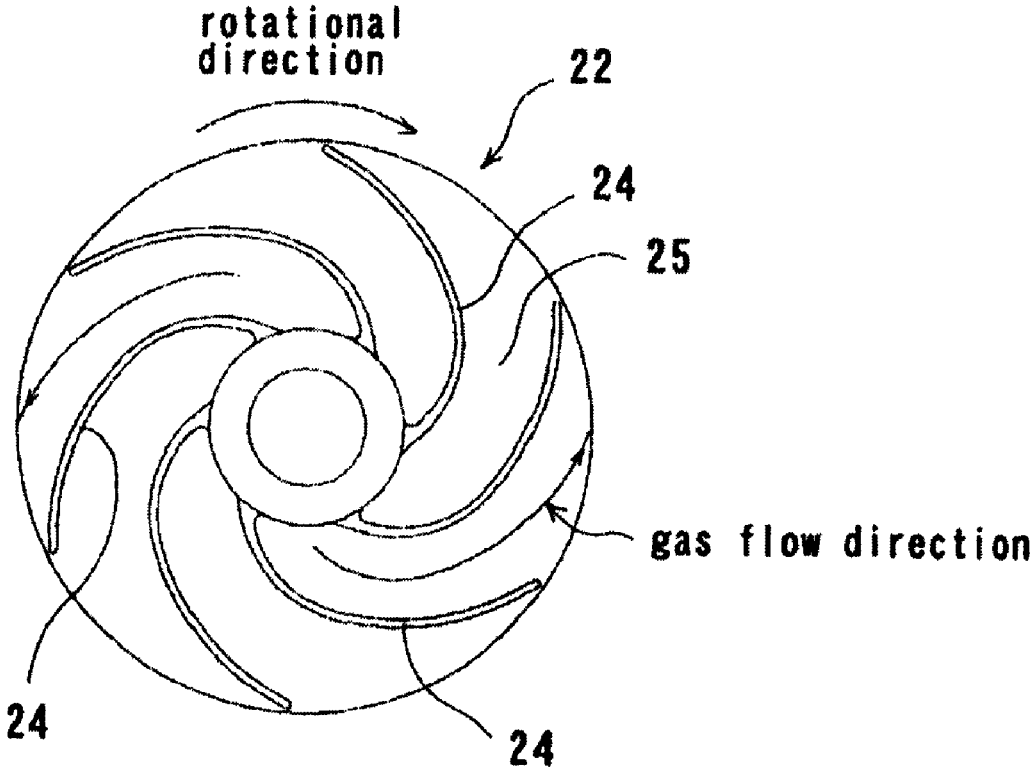
FIGS. 2A and 2B are views of a centrifugal drag blade.
Figure 2B:
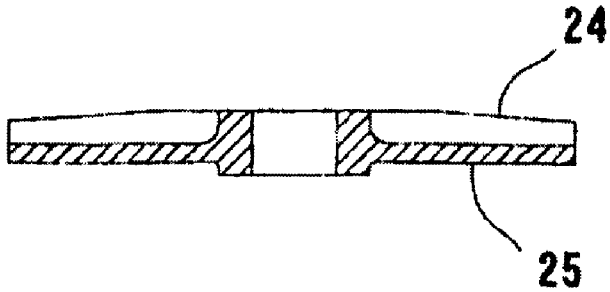

FIGS. 2A and 2B shows the centrifugal drag blade 22, and FIG. 2A is a front view of the centrifugal drag blade 22 and FIG. 2B is a cross-sectional view of the centrifugal drag blade 22. As shown in FIGS. 2A and 2B, the centrifugal drag blade 22 has a plurality of spiral vanes 24 extending spirally from a central portion to an outer peripheral portion of the centrifugal drag blade 22 in the direction opposite to the rotational direction of the centrifugal drag blade 22, and a disk-like base portion 25 to which the spiral vanes 24 are fixed. As shown in FIG. 2A, in the case where the centrifugal drag blade 22 is rotated in a clockwise direction, the spiral vanes 24 extend spirally from an inner diameter side toward an outer diameter side of the centrifugal drag blade 22 in a counterclockwise direction.

Figure 3A:
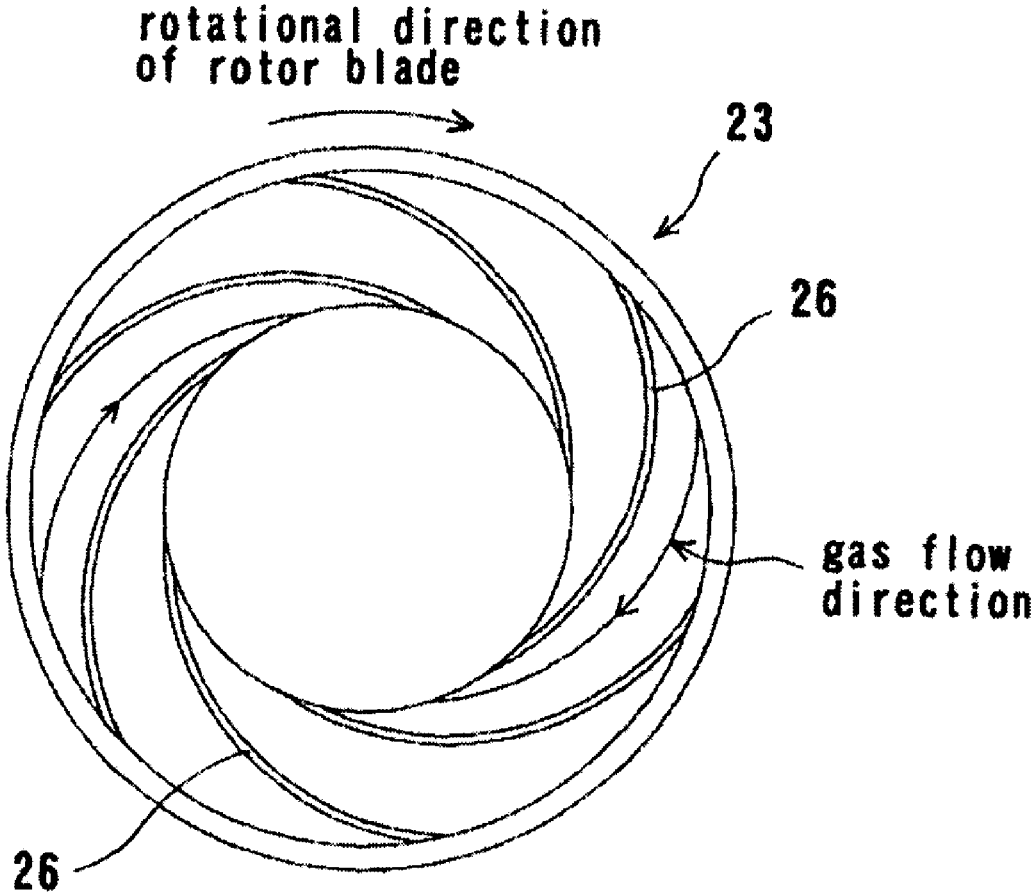
FIGS. 3A and 3B are views of a stator blade.
Figure 3B:
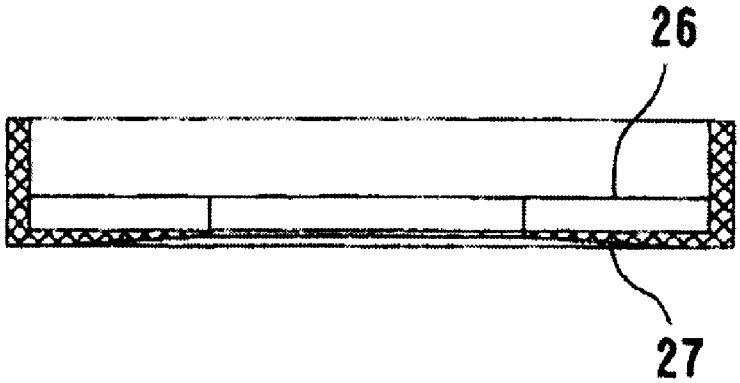

FIGS. 3A and 3B shows the stator blade 23, and FIG. 3A is a front view of the stator blade 23 and FIG. 3B is a cross-sectional view of the stator blade 23. As shown in FIGS. 3A and 3B, the stator blade 23 has a plurality of spiral guides 26 provided at one side of the stator blade 23 and extending spirally from a central portion to an outer peripheral portion of the stator blade 23 in the direction opposite to the rotational direction of the rotor blade (centrifugal drag blade), and a flat surface 27 provided at an axially opposite side of the spiral guides 26. As shown in FIG. 3A, in the case where the rotor blade (centrifugal drag blade) is rotated in a clockwise direction, the spiral guides 26 extend spirally from an inner diameter side toward an outer diameter side of the stator blade 23 in a counterclockwise direction.

The surface of the centrifugal drag blade 22-1 on which the spiral vanes 24 are formed faces the surface of the stator blade 23-1 at several tens to several hundreds μm spacing. Thus, when the centrifugal drag blade 22-1 is rotated, a gas is compressed and evacuated from the inner diameter side toward the outer diameter side of the centrifugal drag blade 22-1 by the interaction of the centrifugal drag blade 22-1 with the stator blade 23-1, i.e. a centrifugal action on the gas and a drag action caused by viscosity of the gas. The gas compressed toward the outer diameter side of the centrifugal drag blade 22-1 flows into spaces between the adjacent spiral guides 26 of the stator blade 23-2, and is then compressed and evacuated from the outer diameter side toward the inner diameter side of the stator blade 23-2 by the drag action caused by viscosity of the gas between the surface of the stator blade 23-2 on which the spiral guides 26 are formed and the surface of the base portion 25 of the centrifugal drag blade 22-1.

The above evacuation action is successively repeated by the multistage centrifugal drag blades 22 and the multistage stator blades 23, and hence high compression and evacuation performance of the gas can be achieved. The structure of the rotor blade (centrifugal drag blade) and the stator blade is not limited to the present embodiment, and optimum types of blades such as a turbine blade, a centrifugal drag blade, or a vortex flow blade may be combined in consideration of the required evacuation performance or dimensions of the blades, or the number of stages may be selected to construct a multistage vacuum pump.

The centrifugal drag blades 22 are attached to a first rotating shaft 28 in such a manner the centrifugal drag blades 22 are successively stacked with a ring member 29 interposed between the adjacent centrifugal drag blades 22. A blade presser member 30 is attached to the top end of the first rotating shaft 28 at the intake port side (the side of the intake port 21A), and a fastening bolt 31 is screwed into the first rotating shaft 28, whereby the centrifugal drag blades 22 are fixed to the first rotating shaft 28.

On the other hand, a shaft fastening flange 32 is provided on the first rotating shaft 28 at the opposite side of the blade presser member 30, and is joined to a second rotating shaft 34 by shaft fastening bolts 33. Thus, the first rotating shaft 28 and the second rotating shaft 34 are integrally coupled to each other.

A motor rotor 35*a* is fixed to the second rotating shaft 34 at a central portion of the second rotating shaft 34, and a motor stator 35*b* is provided so as to surround the motor rotor 35*a*. The motor stator 35*b* is fixed to a housing 54. The motor rotor 35*a* fixed to the second rotating shaft 34 and the motor stator 35*b* fixed to the housing 54 constitute a motor 35 which serves to generate running torque to rotate the centrifugal drag blades 22 through the first and second rotating shafts 28 and 34. Upper and lower radial magnetic bearings 36 and 37 are disposed on both sides of the motor 35 to support the rotor rotatably in a radial direction of the rotor. An axial magnetic bearing 38 is disposed between the motor 35 and the lower radial magnetic bearing 37 to support the rotor rotatably in an axial direction of the rotor. In case that the magnetic bearings 36 through 38 are not operated, auxiliary bearings 52 and 53 are provided to support the rotor rotatably.

The first rotating shaft 28 is disposed in the same space as the evacuation passage formed by the centrifugal drag blades 22 and the stator blades 23, and hence it is desirable that the first rotating shaft 28 is composed of a material which is not adversely affected by the gas evacuated by the vacuum pump. For example, in the case where a corrosive gas is evacuated, the first rotating shaft 28 should be composed of a material having corrosion resistance against the corrosive gas. Further, in the case where a gas containing reaction products is evacuated, heating is generally performed to prevent reaction products from being deposited within the vacuum pump, and hence it is necessary for the first rotating shaft 28 to have heat resisting property against such heating temperature.

Further, in order to ensure evacuation performance of the vacuum pump, the clearance between the centrifugal drag blade 22 and the stator blade 23 should be in the range of several tens to several hundreds μm during operation. Therefore, when the evacuation passage is heated in order to prevent reaction products from being deposited, dimensional change caused by temperature change should be as small as possible. Specifically, by suppressing such dimensional change, the above clearance can be as small as possible, thus improving the pump performance and exhibiting the stable evacuation performance irrespective of temperature change.

On the other hand, the motor 35 and the magnetic bearings 36 through 38 are provided on the second rotating shaft 34, and the second rotating shaft 34 has a great effect on axis vibration characteristics of the rotor. Therefore, the second rotating shaft 34 should be composed of a material having high strength and high Young's modulus. Further, in order to improve output characteristics of the motor or the magnetic bearings, it is more desirable that the second rotating shaft 34 is composed of a ferromagnetic material.

As described above, the first rotating shaft 28 disposed in the evacuation passage, and the second rotating shaft 34 having components of the motor and the bearings for supporting the entire rotor and rotating the entire rotor have different required characteristics from each other. Therefore, the rotating shaft is divided into the first rotating shaft 28 and the second rotating shaft 34. Specifically, the centrifugal drag blades 22 are fixed to the first rotating shaft 28 to form an evacuation passage, the first rotating shaft 28 is constructed so as to have an overhanging structure (cantilever structure), the first rotating shaft 28 is coupled to the second rotating shaft 34 by the shaft fastening flange 32 provided at the end of the first rotating shaft 28, and the motor 35 and the magnetic bearings 36 through 38 are provided on the second rotating shaft 34, thereby constituting a rotor. Thus, a material having characteristics required for the rotating shaft disposed in the evacuation passage, i.e. characteristics of corrosion resistance, heat resistance, low linear expansion, and low density can be selected for the first rotating shaft 28, and a material having high strength, high Young's modulus, and ferromagnetism can be selected for the second rotating shaft 34. That is, materials of the first rotating shaft 28 and the second rotating shaft 34 can be individually selected in consideration of different characteristics required for the first rotating shaft 28 and the second rotating shaft 34. For example, the first rotating shaft 28 is preferably composed of Fe—Ni alloy such as invar or Niresist cast iron, or ceramics, and these materials have coefficient of linear expansion of $5\times10^{-6}$° C.$^{-1}$ or less. Further, the second rotating shaft 34 is preferably composed of martensitic stainless steel, and Young's modulus of the second rotating shaft 34 is about 206 GPa.

Further, tightening torque is imparted to the fastening bolt 31 so that friction force corresponding to rotational torque can be obtained at the contact surfaces between the centrifugal drag blades 22, and the first rotating shaft 28 and the ring members 29. In order to prevent tightening force of the fastening bolt 31 from being changed with temperature change during operation of the vacuum pump, it is desirable that the coefficient of linear expansion of the first rotating shaft 28 is substantially equal to the coefficient of linear expansion of a stacked unit comprising the centrifugal drag blades 22, the ring members 29, and the blade presser member 30.

For example, in the case where the first rotating shaft 28 is made of Niresist cast iron (coefficient of linear expansion $5\times10^{-6}$/K) and the centrifugal drag blade 22 is made of silicon nitride ($Si_3N_4$) ceramics (coefficient of linear expansion $3\times10^{-6}$/K), if the centrifugal drag blades 22 are attached to the first rotating shaft 28 in such a manner that only the centrifugal drag blades 22 are stacked, then the elongation of the centrifugal drag blades 22 is smaller than that of the first rotating shaft 28 owing to temperature rise during operation of the vacuum bump. Thus, the initial tightening (positioning) state may be changed to cause torque transmission from the first rotating shaft 28 to the centrifugal drag blades 22 not to be performed. In order to prevent such problem from occurring, all of the ring members 29 or part of the ring members 29 are composed of other materials such as austenitic stainless steel (coefficient of linear expansion $14\times10^{-6}$/K) so that the elongation of the first rotating shaft 28 becomes substantially equal to that of the stacked unit (the centrifugal drag blades 22+the ring members 29+the blade presser member 30). Thus, since the tightening force of the fastening bolt 31 is not changed, torque transmission from the first rotating shaft 28 to the centrifugal drag blades 22 can be reliably performed irrespective of temperature change of the vacuum pump. However, because the first rotating shaft 28 is thermally expanded owing to temperature rise to exert tensile stress on the inner diameter portions of the centrifugal drag blades 22, an appropriate clearance should be provided between the first rotating shaft 28 and each of the centrifugal drag blades 22.

Figure 4:
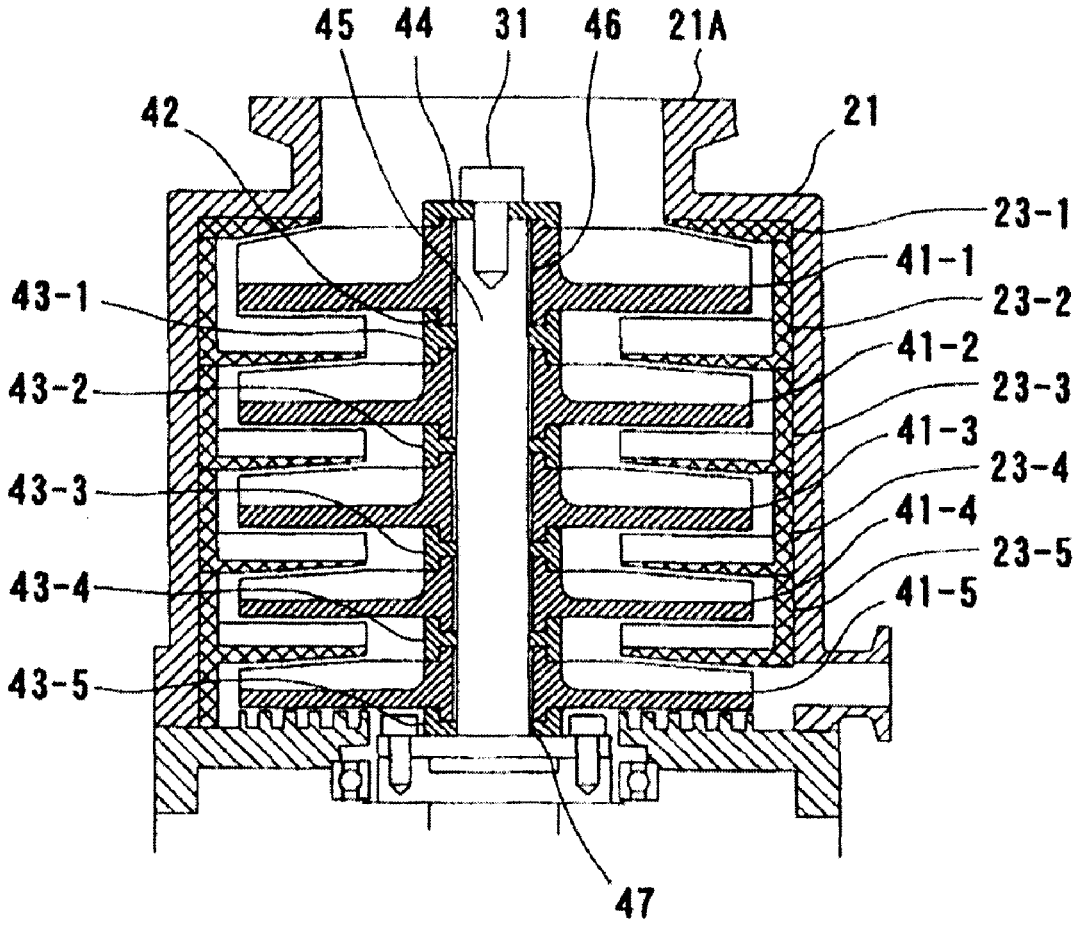
FIG. 4 is a fragmentary cross-sectional view of the turbo vacuum pump which takes measures to cope with thermal expansion in a radial direction of the vacuum pump.

The present embodiment in which measures are taken to cope with the thermal expansion in the axial direction of the vacuum pump is shown. However, it should be noted that measures may be taken to cope with the thermal expansion in the radial direction of the vacuum pump from a standpoint of avoiding the problem occurring at the time of temperature change owing to the difference between coefficient of linear expansion of the first rotating shaft 28 and coefficient of linear expansion of the centrifugal drag blade 22. FIG. 4 shows another embodiment in which measures are taken to cope with the thermal expansion in the radial direction of the vacuum pump.

As shown in FIG. 4, centrifugal drag blades 41-1, 41-2, 41-3, 41-4, and 41-5 (hereafter sometimes referred to simply as centrifugal drag blade 41), ring members 43-1, 43-2, 43-3, 43-4, and 43-5 (hereafter sometimes referred to simply as ring member 43) having respective fitting portions 42 in the axial direction thereof, and a blade presser member 44 are stacked in the axial direction of the vacuum pump. An inner-diameter-side fitting portion 47 of each of the ring members 43-1 through 43-5 is fitted over an outer circumferential portion of a first rotating shaft 45, whereby the position of the stacked unit is fixed in the radial direction of the vacuum pump. At this time, in order to prevent double fitting, a clearance 46 is provided between the outer circumferential portion of the first rotating shaft 45 and each of the inner peripheral portions of the centrifugal drag blades 41-1 through 41-5. Stator blades 23-1 through 23-5 in the present embodiment shown in FIG. 4 have the same structure as the stator blades 23-1 through 23-5 in the first embodiment shown in FIG. 1.

With the above structure, if the first rotating shaft 45 and the ring member 43 are made of Niresist cast iron (coefficient of linear expansion $5\times10^{-6}$/K) and the centrifugal drag blade 41 is made of silicon nitride ($Si_3N_4$) ceramics (coefficient of linear expansion $3\times10^{-6}$/K), looseness of the inner-diameter-side fitting portion 47 caused by temperature rise can be prevented. Further, since the clearance 46 is provided at the inner diameter portion of the centrifugal drag blade 41, tensile stress caused by temperature rise can be prevented from being exerted on the inner diameter portion of the centrifugal drag blade 41. Since the elongation of the ring member 43 is larger than that of the centrifugal drag blade 41 made of ceramics, looseness is likely to generate at the fitting portion 42 owing to temperature rise. Therefore, the fitting portion 42 should be proper interference fit. In general, ceramics have a great strength against compressive stress, and hence the interference fit of the fitting portion 42 is preferable also for the reason of stress exerted on the centrifugal drag blade 41.

Figure 5:
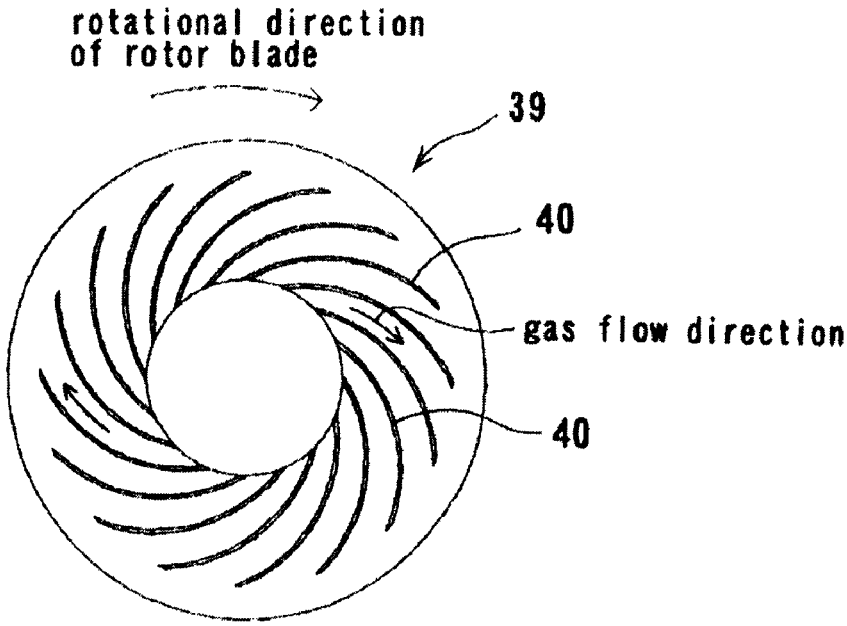
FIG. 5 is a front view of a sealing member incorporated in the turbo vacuum pump shown in FIG. 1.

Next, a sealing member 39 provided in the vicinity of the shaft fastening portion of the first rotating shaft 28 and the second rotating shaft 34 in the vacuum pump shown in FIG. 1 will be described with reference to FIG. 5. FIG. 5 is a front view of the sealing member 39.

As shown in FIG. 5, the sealing member 39 has a plurality of spiral guides 40 at the surface which faces the centrifugal drag blade 22-5 (see FIG. 1). The spiral guides 40 are disposed so as to face the surface of the disk-like base portion of the centrifugal drag blade 22-5 at several tens to several hundreds μm spacing. As shown in FIG. 5, in the case where the rotor blade (centrifugal drag blade) is rotated in a clockwise direction, the spiral guides 40 extend spirally from an inner diameter side toward an outer diameter side of the sealing member 39 in a clockwise direction. When the centrifugal drag blade 22-5 is rotated, a sealing action is generated by the interaction between the centrifugal drag blade 22-5 and the sealing member 39 (see FIG. 1). Thus, the gas evacuated by the pump is prevented from flowing from the outer diameter side of the centrifugal drag blade 22-5 toward the shaft fastening portion side. In this manner, the centrifugal drag blade 22-5 and the sealing member 39 constitute a non-contact sealing mechanism. Further, in order to increase the effect of the sealing action, a gas purge port 51 is provided near the end of the second rotating shaft 34. An inert gas is introduced from the gas purge port 51 and is flowed from the shaft fastening portion side toward the outer diameter side of the centrifugal drag blade 22-5, whereby an inflow of the exhaust gas is reliably prevented from occurring.

With the above structure, the gas evacuated by the vacuum pump is prevented from contacting the motor 35, the magnetic bearings 36 through 38, and the auxiliary bearings 52 and 53. Therefore, silicon steel sheets and copper wire coils which are component materials of the motor 35 and the magnetic bearings 36 through 38 and are inferior in corrosion resistance can be prevented from being corroded. Further, since a gas containing reaction products does not enter such components, it is not necessary to heat such components to a high temperature. Therefore, the copper wire coils of the motor 35 or the magnetic bearings 36 through 38 which are inferior in heat resistance and cause self-heating by current flowing therethrough during operation of the vacuum pump can be protected.

As shown in FIG. 1, a heater 56 is provided at the outer peripheral portion of the casing 21, and a cooling jacket 55 is provided in the housing 54. The heater 56 and the cooling jacket 55 are controlled by a temperature controller 61. Specifically, heating temperature of the heater 56 is controlled by the temperature controller 61, whereby heating temperature of the evacuation passage at the first rotating shaft side (the side of the first rotating shaft 28) is controlled. Further, a circulation flow rate of coolant supplied to the cooling jacket 55 or coolant temperature is controlled by the temperature controller 61, whereby temperature in the housing 54 is controlled.

Further, since the sealing member 39 performs heat insulation between the first rotating shaft side (the side of the first rotating shaft 28) and the second rotating shaft side (the side of the second rotating shaft 34), the sealing member 39 is composed of low thermal conductive material (thermal conductivity 20 W/m·K or less). Thus, even if the evacuation passage at the first rotating shaft side (the side of the first rotating shaft 28) is heated and kept at a high temperature to prevent reaction products from being deposited, the temperature rise of the housing 54 which houses the motor 35 and the magnetic bearings 36 through 38 therein can be suppressed. For example, in the case where the evacuation passage is heated and kept at a desired temperature (for example, 200° C. or higher) by the heater 56 provided at the outer peripheral portion of the casing 21, and the copper wire coils of the motor 35 and the upper radial magnetic bearing 36 are cooled to a desired temperature (for example, 100° C. or lower) by the cooling jacket 55 provided in the housing 54, heat insulation between the casing side (the side of the casing 21) and the housing side (the side of the housing 54) is properly performed by the sealing member 39 to obtain a desired temperature distribution. Further, heat flux from the casing side (the side of the casing 21) to the housing side (the side of the housing 54) is suppressed by the sealing member 39, and hence both of heat input into the heater 56 and endotherm by the cooling jacket 55 can be small to achieve energy saving.

Further, temperature distribution of the vacuum pump can be freely changed using the temperature controller 61 by adjusting the amount of heat of the heater 56 on the basis of input of a temperature sensor 62 for measuring the temperature of the sealing member 39, or adjusting the circulation flow rate of coolant supplied to the cooling jacket 55 on the basis of input of a temperature sensor 63 for measuring the temperature of the copper wire coils of the motor 35, or adjusting coolant temperature, and temperature stability also can be improved. Further, the response to heating rate and cooling rate of the pump at the time of starting and stopping can be enhanced. In the embodiment shown in FIG. 1, a flow control valve 64 is provided in the piping of coolant, and the circulation flow rate of coolant can be regulated.

Figure 6:
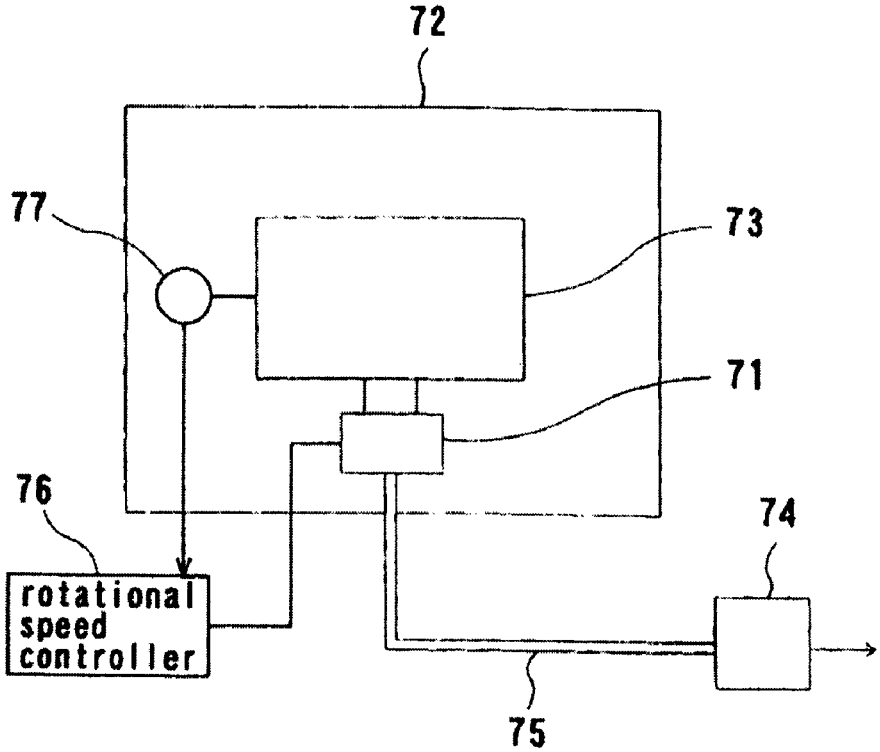
FIG. 6 is a schematic view showing a semiconductor manufacturing apparatus having a vacuum chamber and a vacuum evacuation system comprising a vacuum pump according to the present invention and a piping connecting an exhaust port of the vacuum pump to a backing pump.

FIG. 6 is a schematic view showing a semiconductor manufacturing apparatus 72 having a vacuum chamber 73 and a vacuum evacuation system comprising a vacuum pump 71 according to the present invention and a piping 75 connecting an exhaust port of the vacuum pump 71 to a backing pump 74.

In the vacuum pump 71 according to the present invention, since the second rotating shaft having a great effect on axis vibration characteristics of the rotor is composed of a material having high strength and high Young's modulus, and the bearings comprise magnetic bearings, the vacuum pump can be easily rotated at a high speed. Thus, the evacuation passage section including the rotor blades can be small-sized, and a small-sized, lightweight, low vibratory and contamination-free vacuum pump can be constructed. Therefore, a detrimental effect such as vibration or contamination on the vacuum chamber 73 can be avoided, and an installation space of the vacuum pump can be compact. Thus, the vacuum pump 71 according to the present invention can be easily installed in the vicinity of the vacuum chamber 73 in the semiconductor manufacturing apparatus 72. Further, even if the vacuum chamber 73 is kept at a high temperature under the condition required for the manufacturing process, the vacuum pump according to the present invention whose evacuation passage section can be heated and kept at a high temperature can be easily installed in the vicinity of the vacuum chamber 73.

Therefore, a gas evacuated from the vacuum chamber 73 is immediately compressed by the vacuum pump 71 according to the present invention, and hence the piping 75 is hardly affected by conductance, and the diameter of the piping can be small. Further, since the piping 75 can be lengthened, the degree of freedom of installation location of the backing pump 74 can be increased. Further, since the backing pump 74 does not require large evacuation velocity, the backing pump 74 can be small-sized. Particularly, this structure is effective in the case where a large amount of gas flows in the manufacturing process, or a pressure of the chamber is low.

Further, a rotational speed controller 76 supplies a power for the motor of the vacuum pump 71. The rotational speed controller 76 takes in pressure values as input signals from a pressure gauge 77 installed in the vacuum chamber 73. Then, the rotational speed controller 76 supplies a suitable power (power having a regulated frequency and voltage) to the motor of the vacuum pump 71 to adjust the rotational speed of the vacuum pump 71.

With the above structure, the pressure of the vacuum chamber 73 can be set to various pressure values, and various manufacturing processes can be performed in the same apparatus. Particularly, in the vacuum pump 71 according to the present invention, since moment of inertia of the rotor can be small by making the rotor small-sized, the response to change of the rotational speed of the rotor can be speeded up. Thus, since the rotational speed of the vacuum pump 71 can be varied rapidly, pressure regulation of the vacuum chamber 73 can be easily performed.

In FIG. 6, although the semiconductor manufacturing apparatus has been shown as an apparatus which uses a vacuum evacuation system, any apparatus may be used as an apparatus which is evacuated by the vacuum pump.

Figure 7:
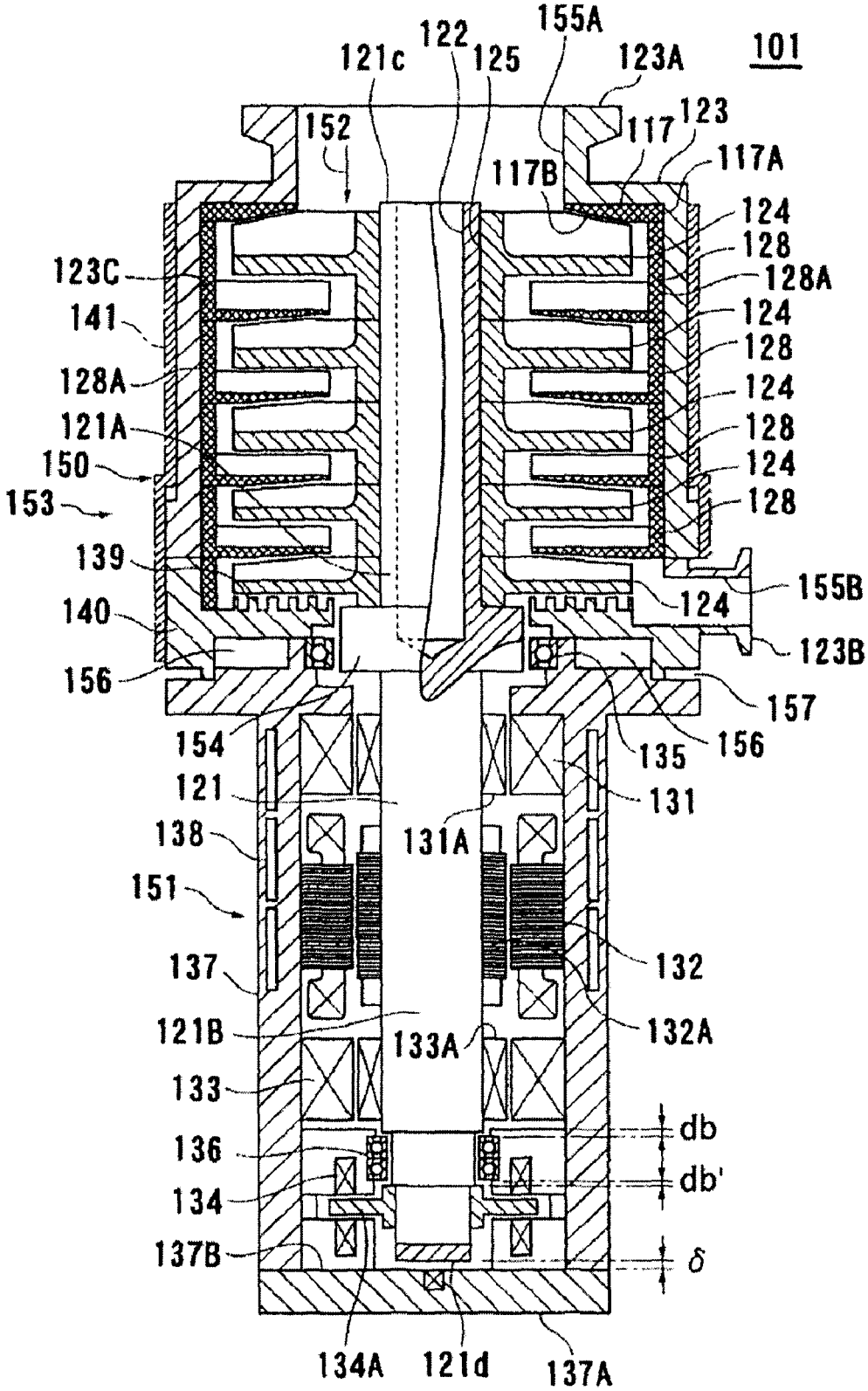
FIG. 7 is a vertical cross-sectional view of a turbo vacuum pump according to a second embodiment of the present invention.
Figure 8:
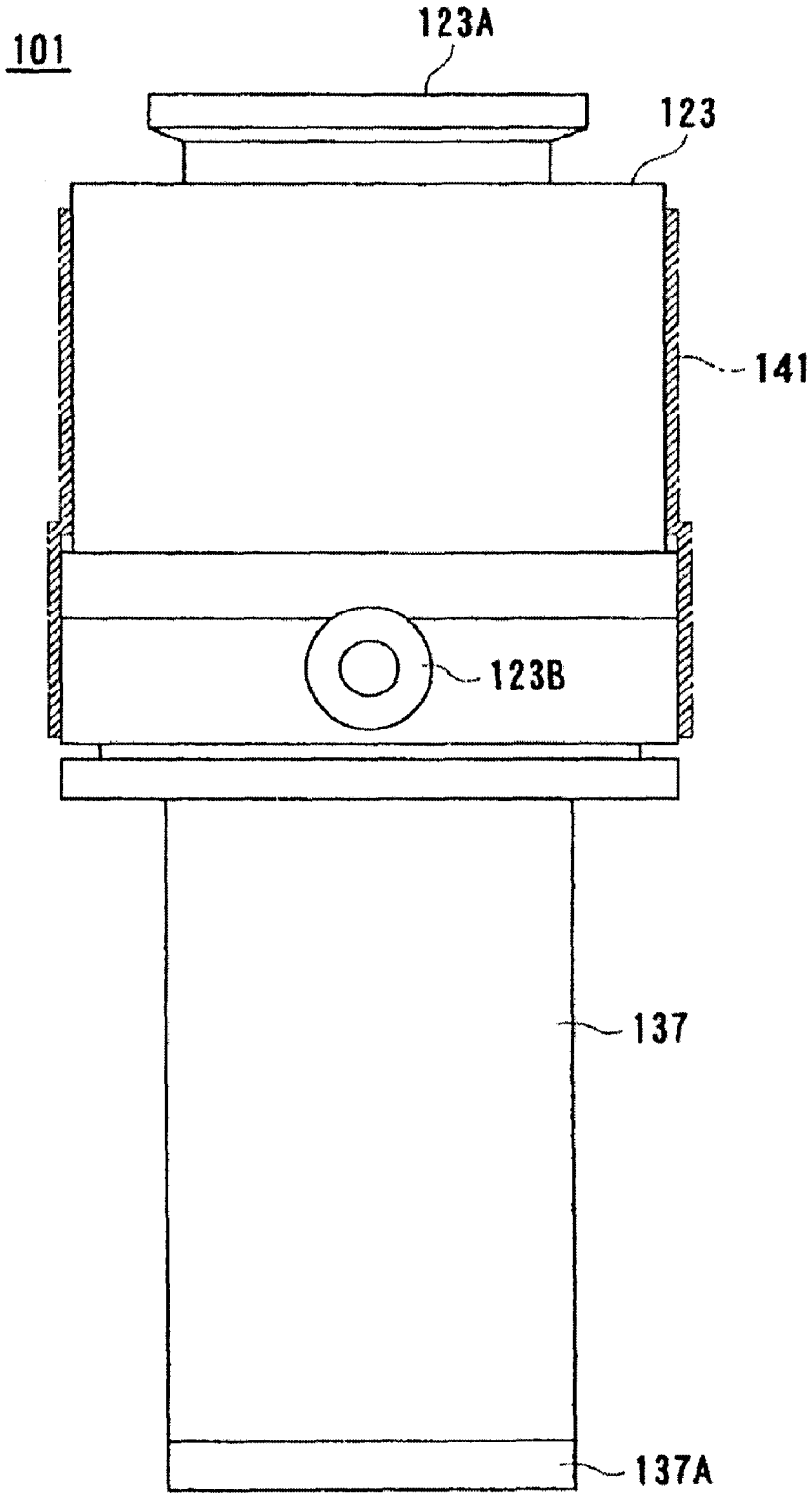
FIG. 8 is a side view of the turbo vacuum pump shown in FIG. 7.

Next, a turbo vacuum pump according to a second embodiment of the present invention will be described below with reference to FIGS. 7 and 8. FIG. 7 is a vertical cross-sectional view of a turbo vacuum pump according to a second embodiment of the present invention, and FIG. 8 is a side view of the turbo vacuum pump shown in FIG. 7. As shown in FIGS. 7 and 8, a turbo vacuum pump 101 (hereafter sometimes referred simply as pump 101) is a vertical type pump, and comprises an evacuation section 150, a motion controlling section 151, a rotating shaft 121, and a casing 153 which houses the evacuation section 150, the motion controlling section 151, and the rotating shaft 121. The rotating shaft 121 is disposed in a vertical direction, and has an evacuation side 121A at the evacuation section side (the side of the evacuation section 150), a motion controlling section side 121B at the motion controlling section side (the side of the motion controlling section 151), and a disk-like larger-diameter portion 154 between the evacuation side 121A and the motion controlling section side 121B.

The casing 153 comprises an upper housing (pump stator) 123, a lower housing 137 disposed at the lower side of the upper housing 123 in a vertical direction (axial direction of the pump 101), and a sub-casing 140 disposed between the upper housing 123 and the lower housing 137. The upper housing 123 has an intake nozzle 123A formed at the uppermost portion of the upper housing 123 and an exhaust nozzle 123B formed at the side surface of the lowermost portion of the upper housing 123, and houses the evacuation section 150 and the evacuation side 121A of the rotating shaft 121 at the evacuation section side (the side of the evacuation section 150). The upper housing 123 has a substantially cylindrical shape, if the intake nozzle 123A and the exhaust nozzle 123B are removed therefrom. The upper housing 123 has an intake port 155A and an exhaust port 155B, and the intake nozzle 123A is connected to the intake port 155A and the exhaust nozzle 123B is connected to the exhaust port 155B. The intake nozzle 123A draws in a gas as a fluid (for example, a corrosive process gas or a gas containing reaction products) downwardly in a vertical direction, and the exhaust nozzle 123B evacuates the drawn gas horizontally.

The evacuation section 150 comprises plural stages (five stages) of stator blades 117 and 128, and plural stages (five stages) of centrifugal drag blades 124 as rotor blades. The first stage stator blade comprises a stator blade 117, and the centrifugal drag blades 124 are disposed downstream of the stator blade 117. The stator blade 117 is in the form of a hollow disk, and has a facing surface 117B which faces the first-stage centrifugal drag blade 124. The facing surface 117B is formed into a flat and smooth surface. The stator blade 117 is housed in the upper housing 123 in such a state that the outer circumferential portion 117A of the stator blade 117 contacts the inner circumferential portion 123C of the upper housing 123. The second-stage through fifth-stage stator blades comprises stator blades 128, and each of the stator blades 128 is disposed so as to be interposed between the centrifugal drag blades 124. The stator blade 128 is housed in the upper housing 123 in such a state that the outer circumferential portion 128A of the stator blade 128 contacts the inner circumferential portion 123C of the upper housing 123. Each of the centrifugal drag blades 124 has a through-hole 125 at the central portion thereof, and the evacuation side 121A of the rotating shaft 121 is fitted into the through-hole 125, whereby the centrifugal drag blade 124 is fixed to the rotating shaft 121. The stator blades 117 and 128, and the centrifugal drag blades 124 are alternately disposed from the vertically upper side to the vertically lower side. Specifically, the stator blade 117 is disposed at the uppermost position, and the centrifugal drag blades 124 and the stator blade 128 are disposed alternately, and then the centrifugal drag blade 124 is disposed at the lowermost position. A gas evacuated by the final-stage (fifth-stage) centrifugal drag blade 124 flows horizontally in the exhaust nozzle 123B, and is then discharged horizontally from the exhaust nozzle 123B.

The lower housing 137 houses the motion controlling section 151, and the motion controlling section side 121B of the rotating shaft 121 at the motion controlling section side (the side of the motion controlling section 151). The motion controlling section 151 comprises an upper protective bearing 135, an upper radial magnetic bearing 131, a motor 132 for rotating the rotating shaft 121, a lower radial magnetic bearing 133, a lower protective bearing 136, an axial magnetic bearing 134 which are arranged in this order from the vertically upper side to the vertically lower side. A portion of the rotating shaft 121 projecting upwardly from the upper radial magnetic bearing 131, i.e. a portion of the rotating shaft 121 located above the portion between the upper radial magnetic bearing 131 and the lower radial magnetic bearing 133 is an overhanging portion of the present invention. The upper radial magnetic bearing 131 and the lower radial magnetic bearing 133 support the rotating shaft 121 rotatably. The axial magnetic bearing 134 supports a downward force corresponding to deadweight of the rotor (composed of the rotating shaft 121, the centrifugal drag blades 124, a motor rotor 132A of a motor 132, an upper radial magnetic bearing target 131A, a lower radial magnetic bearing target 133A, and an axial magnetic bearing target 134A) minus a thrust force applied to the rotating shaft.

Each of the magnetic bearing 131, 133, and 134 comprises an active magnetic bearing. If an abnormality occurs in anyone of the magnetic bearings 131, 133, and 134, the upper protective bearing 135 supports the rotating shaft 121 in a radial direction of the rotating shaft 121 instead of the upper radial magnetic bearing 131, and the lower protective bearing 136 supports the rotating shaft 121 in radial and axial directions of the rotating shaft 121 instead of the lower radial magnetic bearing 133 and the axial magnetic bearing 134.

The centrifugal drag blades 124 are fitted over the evacuation side 121A of the rotating shaft 121 and are stacked one after another. The first-stage centrifugal drag blade 124 is disposed in the vicinity of the free end 121C of the evacuation side 121A of the rotating shaft 121. The final-stage centrifugal drag blade 124 is disposed so as to contact the larger-diameter portion 154, and the larger-diameter portion 154 serves as a positioning mechanism in assembling the centrifugal drag blades 124 onto the rotating shaft 121. A drill hole (hollow portion) 122 is formed in the evacuation side 121A of the rotating shaft 121 and a part of the larger-diameter portion 154, thus making the rotating shaft 121 hollow-shaft structure. In FIG. 7, the drill hole 122 is shown partly by broken lines and partly by solid lines. The drill hole 122 has a substantially cylindrical shape, and the central axis of the drill hole 122 is aligned with the central axis of the rotating shaft 121. The drill hole 122 extends from the end of the evacuation side 121A to part of the larger-diameter portion 154 in the axial direction of the rotating shaft 121. However, the drill hole 122 may be formed in part of the evacuation side 121A in the axial direction of the rotating shaft 121 (not shown in the drawing). Further, the drill hole 122 may extend from the end of the evacuation side 121A to the entirety of the larger-diameter portion 154 in the axial direction of the rotating shaft 121 (not shown in the drawing).

In the embodiment shown in FIG. 7, the full or partial overhanging portion of the rotating shaft 121 has a hollow-shaft structure, and this hollow-shaft structure may be applied to the first rotating shaft 28 in the first embodiment shown in FIG. 1. Specifically, the drill hole may be formed in part or whole of the first rotating shaft 28 shown in FIG. 1, whereby part or whole of the first rotating shaft 28 may be made a hollow-shaft structure.

As shown in FIG. 7, the lower housing 137 is provided with a cooling jacket 138 serving as a cooling mechanism. The cooling jacket 138 is supplied with cooling water (not shown), whereby the lower housing 137 is kept at a temperature of 20 to 80° C. Further, the centrifugal drag blades 124, and the stator blades 117 and 128 are kept at a temperature of 100 to 300° C., for example, by being heated with a heater 141 (described later) or the like, and the rotating shaft 121 is kept at a temperature of 100 to 150° C., for example.

The sub-casing 140 is disposed substantially at the same height as the larger-diameter portion 154 of the rotating shaft 121. A sealing mechanism 139 which utilizes the reverse surface 127B (see FIG. 9B) of the final-stage centrifugal drag blade 124 is formed on the upper surface of the sub-casing 140. The sealing mechanism 139 is of labyrinth structure having concentric circular grooves. A vacuum space heat insulating section 156 and an atmospheric space heat insulating section 157 are formed between the sub-casing 140 and the lower housing 137 so that a contact portion between the sub-casing 140 and the lower housing 137 has a small area. Thus, heat is hard to be transmitted from the sub-casing 140 to the lower housing 137. Therefore, the pump 101 according to the present embodiment is constructed such that the evacuation section 150 and the motion controlling section 151 are environmentally and thermally separable from each other by the sub-casing 140 (for example, only the motion controlling section 151 is held in a gas atmosphere).

Figure 9A:
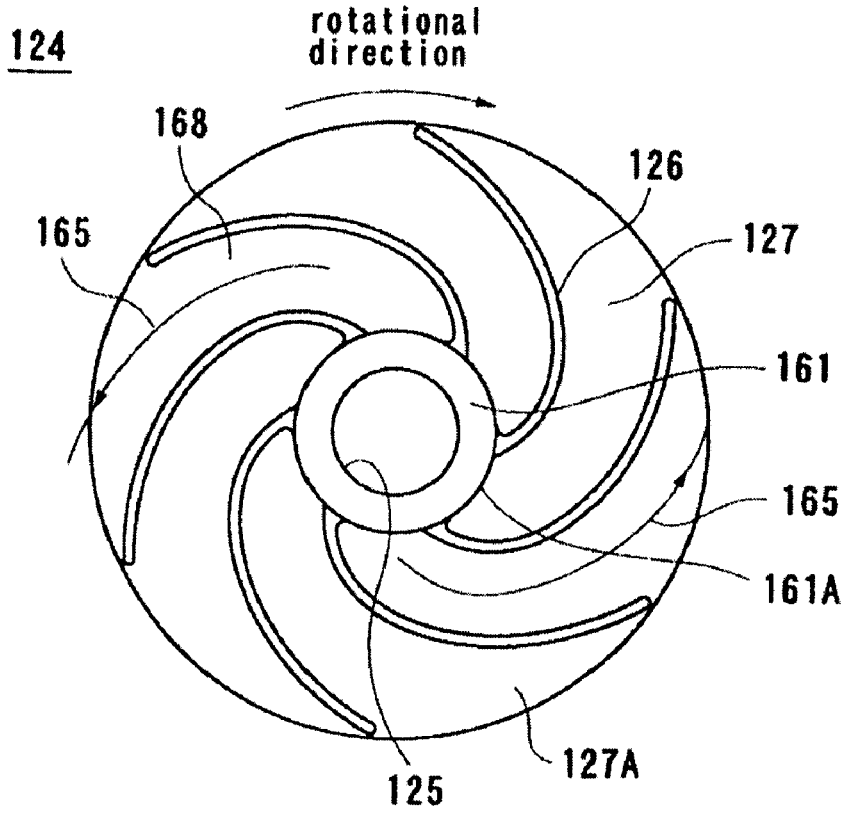
FIG. 9A is a plan view of a centrifugal drag blade of the turbo vacuum pump shown in FIG. 7.
Figure 9B:
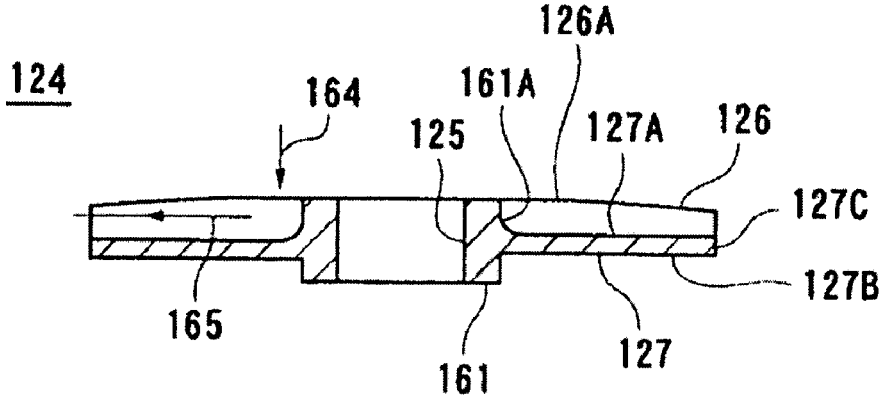
FIG. 9B is a front cross-sectional view of the centrifugal drag blade of the turbo vacuum pump shown in FIG. 7.

Next, the structure of the centrifugal drag blade 124 will be described with reference to FIGS. 9A and 9B. FIG. 9A is a plan view of the centrifugal drag blade 124 as viewed from the intake nozzle side (the side of the intake nozzle 123A (FIG. 7)), and FIG. 9B is a front cross-sectional view of the centrifugal drag blade 124. The centrifugal drag blade 124 comprises a substantially disk-like base portion 127 having a hub portion 161, and spiral vanes 126 fixed to the surface 127A of the base portion 127. The centrifugal drag blade 124 is rotated in a clockwise direction in FIG. 9A.

The spiral vane 126 comprises a plurality (six) of spiral-shaped vanes as shown in FIG. 9A. The spiral vanes 126 extend in a direction opposite to the rotational direction of the centrifugal drag blade 124 and in a direction of a gas flow. The spiral vanes 126 having respective front end surfaces 126A at the intake side extend from the outer circumferential surface 161A of the hub portion 161 to the outer peripheral portion 127C of the base portion 127. The surface opposite to the surface 127A is a reverse surface 127B, and the surface 127A and the reverse surface 127B are perpendicular to a central axis of the rotating shaft 121 (see FIG. 7). The above through-hole 125 is formed in the hub portion 161.

The method for forming the centrifugal drag blade 124 from a disk-shaped material (not shown) by machining such as end mill working to form the spiral vanes 126 projecting from the base portion 127 is the most popular method for forming the rotor blade which is rotated at a high speed (for example, a circumferential speed of 300 to 500 m/s) from the viewpoint of improvement of blade dimension accuracy and use of high specific strength materials (for example, aluminum alloy, titanium alloy, ceramics, or the like). Although it is considered that a plurality of centrifugal drag blades are integrated and manufactured by various casting processes, since defects are likely to be generated inside the cast, and dimensional accuracy, particularly dimensional accuracy of spiral vanes is inherently poor, evacuation performance of the pump 101 (see FIG. 7) tends to be unstable. Therefore, casting is not suited to the manufacture of the centrifugal drag blade 124.

Figure 10A:
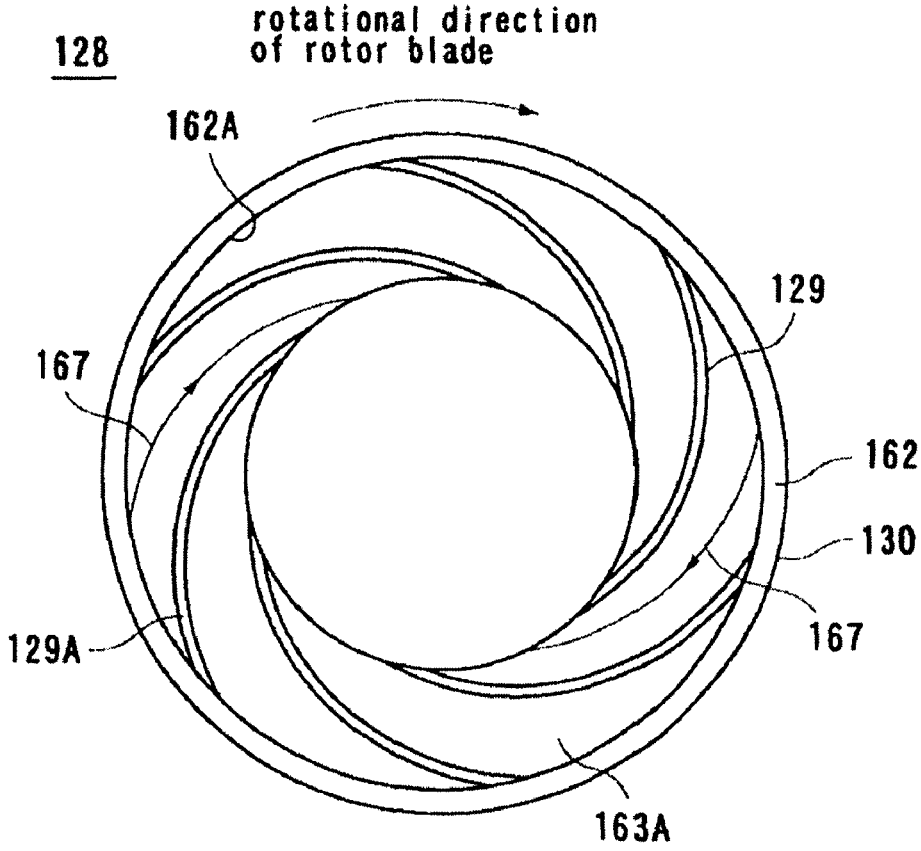
FIG. 10A is a plan view of a stator blade of the turbo vacuum pump shown in FIG. 7.
Figure 10B:
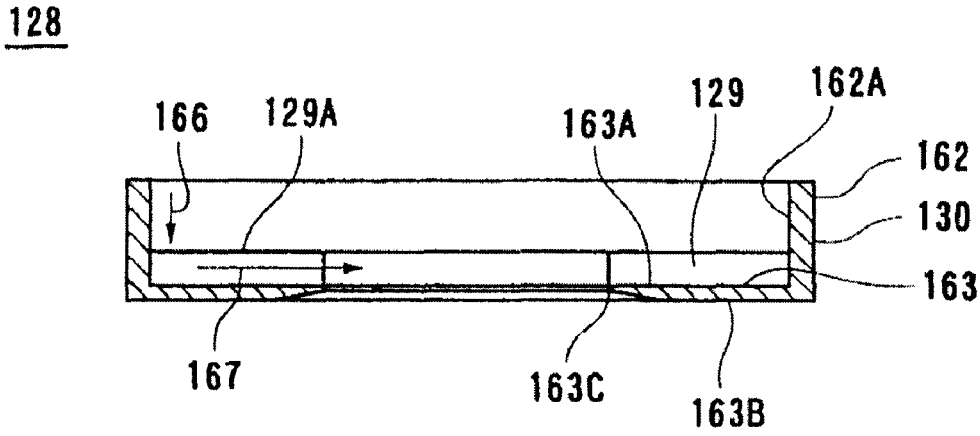
FIG. 10B is a front cross-sectional view of the stator blade of the turbo vacuum pump shown in FIG. 7.

Next, the structure of the second-stage through fifth-stage stator blades 128 will be described below with reference to FIGS. 10A and 10B. FIG. 10A is a plan view of the stator blade 128 as viewed from the intake nozzle side (the side of the intake nozzle 123A (FIG. 7)), and FIG. 10B is a front cross-sectional view of the stator blade 128. The stator blade 128 comprises a stator blade body 130 having an outer circumferential wall 162 and a side wall 163, and a plurality of spiral guides 129 projecting from a surface 163A of the side wall 163 and having a rectangular cross-section. The centrifugal drag blade 124 is rotated in a clockwise direction in FIG. 10A.

The spiral guides 129 comprises a plurality (six) of spiral-shaped guides as shown in FIG. 10A. The spiral guides 129 extend in the same direction as the rotational direction of the centrifugal drag blade 124 and in a direction of a gas flow. The spiral guides 129 extend from the inner peripheral portion 162A of the outer circumferential wall 162 to the inner peripheral portion 163C of the side wall 163. The end surfaces 129A of the spiral guides 129 are located in a plane perpendicular to the central axis of the rotating shaft 121, and are smooth surfaces. A reverse surface 163B of the side wall 163 opposite to the spiral guides 129 is a flat and smooth surface. Therefore, the reverse surface 163B of the stator blade 128 facing the spiral vanes 126 of the centrifugal drag blade 124 (see FIG. 9) does not disturb a gas flow flowing through fluid passages 168 (see FIG. 9A) formed between the adjacent spiral vanes 126 of the centrifugal drag blade 124.

Figure 11:
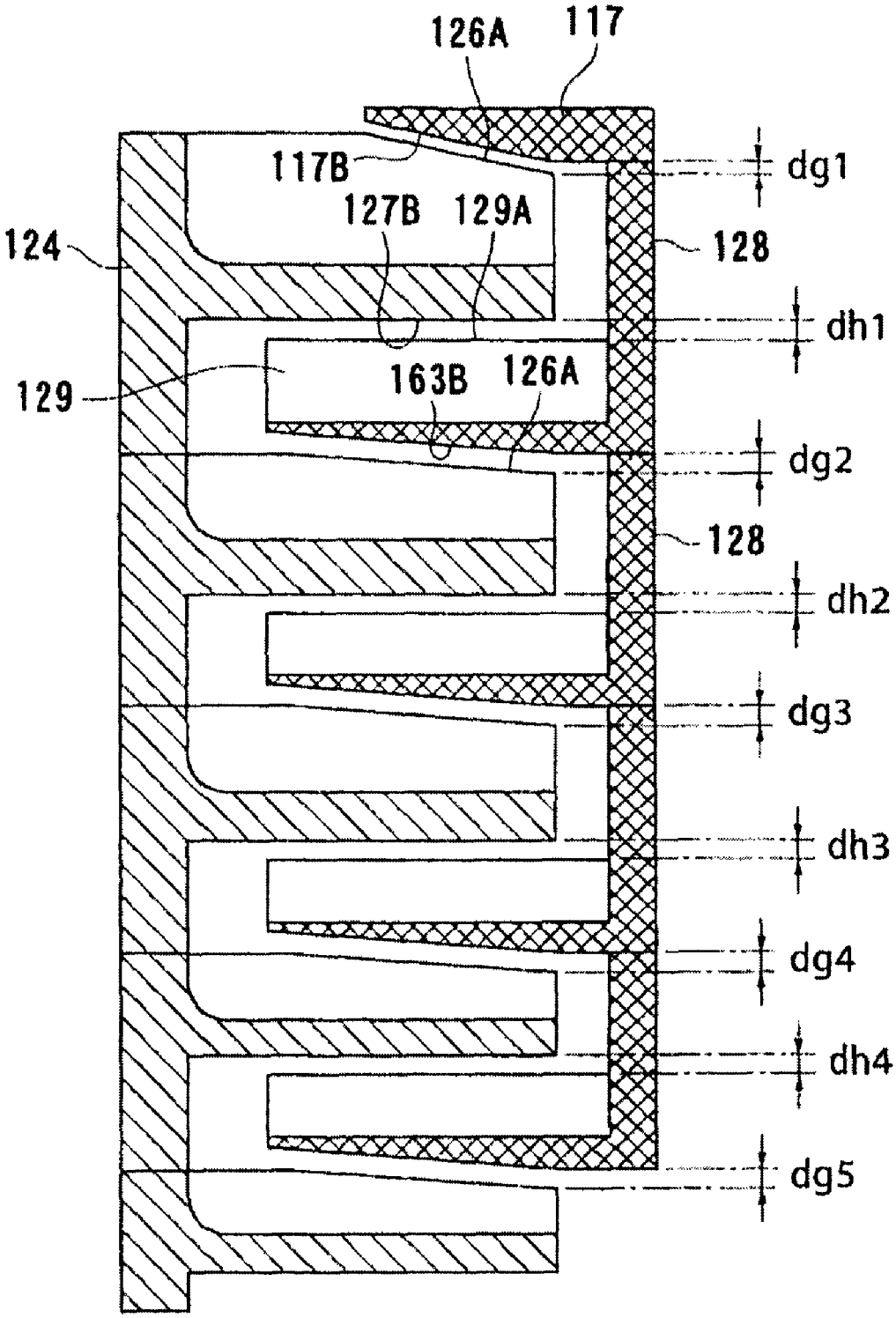
FIG. 11 is an enlarged fragmentary cross-sectional view of the centrifugal drag blades and the stator blades of the turbo vacuum pump shown in FIG. 7.

Next, clearances between the stator blades 117 and 128, and the centrifugal drag blades 124 will be described with reference to FIGS. 7 and 11. FIG. 11 is an enlarged fragmentary cross-sectional view of the centrifugal drag blades 124 and the stator blades 117 and 128 in the turbo vacuum pump 101 shown in FIG. 7.

The front end surface 126A of the first-stage centrifugal drag blade 124 faces the surface 117B of the first-stage stator blade 117 at a clearance of dg1 in the axial direction of the pump 101. The reverse surfaces 127B of the second-stage through fifth-stage centrifugal drag blades 124 face the end surfaces 129A of the spiral guides 129 of the second-stage through fifth-stage stator blades 128 at respective gaps dh1, dh2, dh3, and dh4 in the axial direction of the pump 101. The reverse surfaces 163B of the second-stage through fifth-stage stator blades 128 face the front end surfaces 126A of the second-stage through fourth-stage centrifugal drag blades 124 at respective gaps dg2, dg3, dg4 and dg5 in the axial direction of the pump 101. The above axial gaps dg1 through dg5 are called a gap between the stator blade 117 or 128 and the centrifugal drag blade 124. This gap is in the range of several tens to several hundreds μm, for example, between the first-stage stator blade 117 and the first-stage centrifugal drag blade 124.

Figure 12:
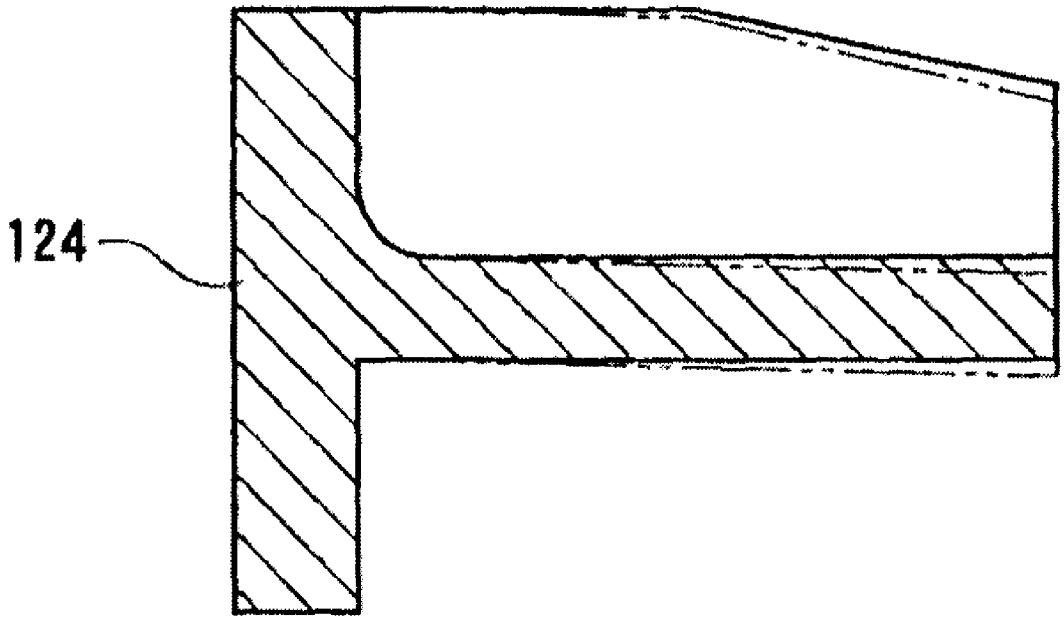
FIG. 12 is a schematic view showing the manner in which the centrifugal drag blade of the turbo vacuum pump shown in FIG. 7 is deformed by rotational stress.

The smaller the gap is, the higher the pump performance is. The effect of the gap on the pump performance is larger as operating pressure of the pump is higher. Therefore, it is desirable that the gaps are gradually narrower toward the evacuation side. Since the intake side is a low pressure side, even if the gap is large, the contribution rate to lower the pump performance is small. The control type magnetic bearing 134 which controls the gap δ (gap between the lower end portion 121*d* of the rotating shaft 121 and the inner bottom surface 137B of the lower housing 137) at a constant value is used as an axial bearing as in the present embodiment. In that case, the gap is set so as to be as narrow as possible in consideration of the axial gap db, db' between the rotating shaft 121 and the protective bearing 135 or 136, a deformation in which the outer peripheral side of the centrifugal drag blade 124 hangs down because of rotational stress (deformation of the centrifugal drag blade 124 shown by the two-dot chain lines in FIG. 12), and a thermal deformation in which the rotating shaft 121 extends upwardly from the lower end portion 121*d* as a reference point because of temperature rise. The gap should be in the range of one-thousands to one-hundreds the outer diameter of the centrifugal drag blade 124.

The rotating shaft 121 lengthens upwardly by thermal expansion from the lower end portion 121*d* as a reference point. If temperature and coefficient of linear expansion of the rotating shaft 121 and temperature and coefficient of linear expansion of the casing 153 are suitably selected, then the above gap can be as small as possible.

In the case of the centrifugal drag blade 124, since the centrifugal effect is more effectively utilized in the gas flow from the inner diameter side to the outer diameter side, i.e. in the gas flow flowing along the spiral vanes 126, the effect of the gap on the pump performance is larger. The centrifugal drag blade 124 is deformed by the rotational stress, as described above, such that the outer peripheral side of the centrifugal drag blade 124 hangs down. Therefore, the gap between the reverse surface 163B of the stator blade 128 and the front end surface 126A of the centrifugal drag blade 124 where the gas flows from the inner diameter side to the outer diameter side should be set to be narrow, while the gap between the reverse surface 127B of the centrifugal drag blade 124 and the end surface 129A of the stator blade 128 where the gas flows from the outer diameter side to the inner diameter side should be set to be the same as or two times the above gap.

Next, the operation of the turbo vacuum pump 101 will be described with reference to FIGS. 7, 8, 9A, 9B, 10A and 10B.

When the first-stage centrifugal drag blade 124 is rotated, a gas is introduced in a substantially axial direction 152 from the intake nozzle 123A into the pump 101. The gas introduced into the first-stage centrifugal drag blade 124 is compressed and evacuated along the surface 127A of the base portion 127 of the first-stage centrifugal drag blade 124 toward the outer diameter side of the first-stage centrifugal drag blade 124 by the interaction of the first-stage centrifugal drag blade 124 and the first-stage stator blade 117, i.e. a drag action caused by viscosity of the gas and a centrifugal action on the gas by rotation of the centrifugal drag blade 124.

Specifically, a gas introduced into the vacuum pump 101 is introduced in a substantially axial direction 164 into the first-stage centrifugal drag blade 124 in FIG. 9B, flows through the passages 168 formed between the spiral vanes 126 of the first-stage centrifugal drag blade 124 toward the outer diameter side, and compressed and evacuated. The flow of the gas is in a radially outward direction 165 in FIGS. 9A and 9B, and this direction is a flow direction of the gas with respect to the first-stage centrifugal drag blade 124.

The gas compressed toward the outer diameter side by the first-stage centrifugal drag blade 124 flows in the second-stage stator blade 128, changes its direction toward a substantially axial direction 166 by the inner peripheral portion 162A of the outer circumferential wall 162 in FIG. 10B, and then flows into the spaces provided by the spiral guides 129. The gas is compressed and evacuated along the surface 163A (surface of the side wall 163 on which the spiral guides 129 are provided) of the side wall 163 of the second-stage stator blade 128 toward the inner diameter side of the second-stage stator blade 128 by a drag action caused by viscosity of the gas between the end surfaces 129A of the spiral guides 129 of the stator blade 128 and the reverse surface 127B of the base portion 127 of the first-stage centrifugal drag blade 124 by rotation of the first-stage centrifugal drag blade 124. Since the reverse surface 127B is a flat surface, a centrifugal force caused by the rotation of the first-stage centrifugal drag blade 124 and having an adverse effect on the performance of the pump does not act on the reverse surface 127B.

The gas which has reached the inner diameter side of the second-stage stator blade 128 changes its direction toward a substantially axial direction 164 in FIG. 9B by the outer circumferential surface 161A of the hub portion 161 of the first-stage centrifugal drag blade 124, and is then introduced into the second-stage centrifugal drag blade 124.

The gas introduced into the second-stage centrifugal drag blade 124 is compressed and evacuated along the surface 127A of the base portion 127 of the second-stage centrifugal drag blade 124 toward the outer diameter side of the second-stage centrifugal drag blade 124 by the interaction of the second-stage centrifugal drag blade 124 and the second-stage stator blade 128, i.e. a centrifugal action on the gas and a drag action caused by viscosity of the gas.

The above evacuation action is successively repeated by the second-stage and the subsequent-stage centrifugal drag blades 124 and the stator blade 128, and hence a large amount of gas (for example, 1 to 20 SL per minutes) can be compressed and evacuated to a vacuum degree ranging from about $10^{-1}$-$10^{-5}$ Torr to $10^{0}$-$10^{1}$ Torr. The structure of the centrifugal drag blades and the stator blades is not limited to the present embodiment, and optimum types of blades including a turbine blade (a plurality of blades having a certain helix angle twisted from a plane passing through a central axis are radially provided on an outer peripheral portion of a hub portion) (see FIG. 13), a vortex flow blade (a plurality of relatively short blades having no helix angle twisted from a plane passing through a central axis are radially provided on an outer peripheral portion of a hub portion) (not shown) may be combined in consideration of the required evacuation performance or dimensions of the centrifugal drag blade and the stator blade, or the number of stages may be selected to construct an optimum multistage vacuum pump. A combination of the turbine blade and the centrifugal drag blade will be described later on.

Further, the pump 101 according to the present embodiment has the evacuation section 150 and the motion controlling section 151 which are separated from each other in the axial direction of the pump 101, and hence the pump 101 having excellent corrosion resistance and heat resisting property can be easily constructed.

Specifically, in the case where the pump 101 evacuates a corrosive gas, the rotating shaft 121, the centrifugal drag blades 124, the stator blades 128, and the upper housing 123 which jointly constitute the evacuation section 150 are composed of a material having corrosion resistance (for example, nickel alloy, titanium alloy, aluminum alloy, ceramics ($Si_3N_4$, $Al_2O_3$, SiC, $ZrO_2$, $Y_2O_3$, or the like)), or are subjected to surface treatment of a material having corrosion resistance (for example, nickel coating, PTFE coating, ceramics coating ($Si_3N_4$, $Al_2O_3$, SiC, $ZrO_2$, $Y_2O_3$, or the like)). Further, components of the magnetic bearings 131, 133 and 134 and the motor 132 which have poor corrosion resistance are protected from corrosion by providing the sealing mechanism 139 at the boundary between the evacuation section 150 and the motion controlling section 151. With this arrangement, the pump 101 having excellent corrosion resistance can be constructed.

Further, an inert gas such as nitrogen gas may be purged from the end 137A of the lower housing 137 which houses the motion controlling section 151. With this arrangement, the motion controlling section 151 is kept in an inert gas atmosphere, and a function of the sealing mechanism 139 can be reinforced.

In the pump 101 according to the present embodiment, when a gas containing reaction products is evacuated, the evacuation section 150 is required to be heated so that reaction products are not deposited in the evacuation section 150. In this case also, the rotating shaft 121, the centrifugal drag blades 124, the stator blades 128, the upper housing 123 and the sub-casing 140 jointly constituting the evacuation section 150 may be heated to a temperature of, for example, 100 to 300° C. by a heater 141 (shown by alternate long and short dash line in FIGS. 7 and 8) serving as a heating mechanism attached to the outer circumferential portions of the upper housing 123 and the sub-casing 140. Further, in this case, it is desirable that a cooling jacket (cooling mechanism) (not shown) having cooling capacity higher than that of the cooling jacket 138 is provided in the lower housing 137, components of the magnetic bearings 131, 133 and 134 and the motor 132 having poor heat resistance are cooled by cooling water (not shown), whereby the rotating shaft 121 is kept at a temperature of, for example, 100 to 150° C. and such components are protected from high temperature deterioration. With this arrangement, the vacuum pump having the evacuation section 150 can be stably heated to a high temperature so that reaction products can be prevented from being deposited, and can be stably operated over a long period of time.

As described above, according to the pump 101 of the present embodiment, since the drill hole 122 is formed in the overhanging portion of the rotating shaft 121, a force by deadweight applied to the overhanging portion of the rotating shaft 121 can be reduced without lowering bending rigidity of the overhanging portion of the rotating shaft 121 by setting the outer diameter of the rotating shaft 121 and the inner diameter of the drill hole 122 to appropriate values. Thus, bending moment applied to the rotating shaft 121 can be small by using the overhanging structure. Therefore, vibration of the pump 101 can be reduced, and the maximum rotational speed of the operating range can be increased and the minimum rotational speed of the operating range can be decreased in such a state that natural frequency of rotational system is not affected, thereby constructing the pump 101 having a wide operating range. Further, by shortening the spacing between the bearing 131 and the bearing 133, the diameter of the rotating shaft 121 between the bearing 131 and the bearing 133 can be small, the bearing load applied to the bearing 131 at the overhanging portion side can be small to allow the bearing at the overhanging portion side to be small-sized. Thus, the vacuum pump 101 can be small-sized and lightweight without lowering pump performance. Further, since the bearing load applied to the bearing 131 at the overhanging portion side can be small, vibration of the overhanging portion caused by rotational unbalance can be relatively small.

The gas flows in the plane perpendicular to the central axis of the rotating shaft until the gas discharged from the final-stage (fifth-stage) stator blade 128 is discharged from the exhaust port 155B, and then the gas discharged from the exhaust port 155B is discharged from the exhaust nozzle 123B. Therefore, an additional space is not required in the axial direction of the pump for the purpose of gas evacuation in the upper housing 123, and hence the axial length of the overhanging portion can be shortened. Therefore, bending moment applied to the rotating shaft 121 can be small by using the overhanging structure.

Figure 13:
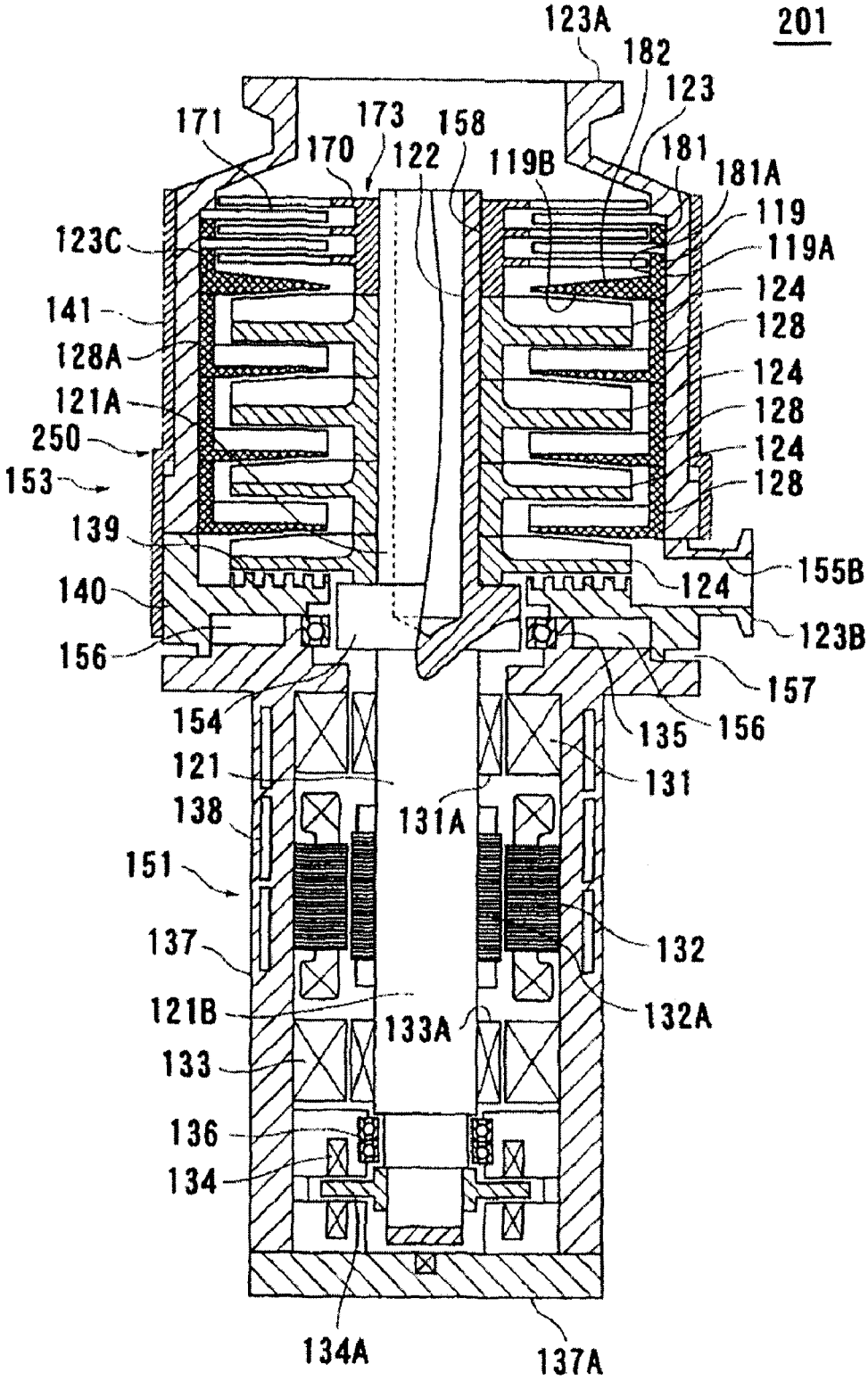
FIG. 13 is a vertical cross-sectional view of a turbo vacuum pump according to a third embodiment of the present invention.

Next, a turbo vacuum pump 201 according to a third embodiment of the present invention will be described with reference to FIG. 13. In this case, the structure of the turbo vacuum pump 201 different from the turbo vacuum pump 101 (see FIG. 7) according to the first embodiment of the present invention is mainly described. FIG. 13 is a vertical cross-sectional view of the turbo vacuum pump 201. The components of the turbo vacuum pump 201 in FIG. 13 denoted by the same reference numerals as those in FIG. 7 are the same components as those of the turbo molecular pump 101 in FIG. 7.

The turbo vacuum pump 201 includes an evacuation section 250. The evacuation section 250 comprises three stages of turbine blades 170 as rotor blades, four stages of centrifugal drag blades 124 as rotor blades disposed at the subsequent stage of the turbine blade 170, two stages of stator blades 171 disposed between the turbine blades 170, a single stage of stator blade 119 disposed at the downstream side of the stator blade 171, and four stages of stator blades 128 disposed at the downstream side of the stator blade 119.

The three stages of the turbine blades 170 are integrally formed and constitute a turbine blade assembly 173. A through-hole 158 is formed in the central portion of the turbine blade assembly 173. The forward end portion of the evacuation side 121A of the rotating shaft 121 is inserted into the through-hole 158, whereby the turbine blade assembly 173 is attached to the rotating shaft 121. The stator blade 119 is dispose so as to be interposed between the third-stage turbine blade 170 and the fourth-stage centrifugal drag blade 124. The stator blade 119 has an outer circumferential wall 181 which is formed into a hollow cylinder, and a side wall 182 formed into a hollow disk and disposed horizontally. The side wall 182 is attached to an inner circumferential surface 181A of the outer circumferential wall 181. The side wall 182 has a facing surface 119B facing the fourth-stage centrifugal drag blade 124, and the facing surface 119B is formed into a flat and smooth surface. The stator blade 119 is housed in the upper housing 123 in such a state that the outer circumferential portion 119A (outer circumferential portion of the outer circumferential wall 181) of the stator blade 119 contacts the inner circumferential portion 123C of the upper housing 123.

Figure 14A:
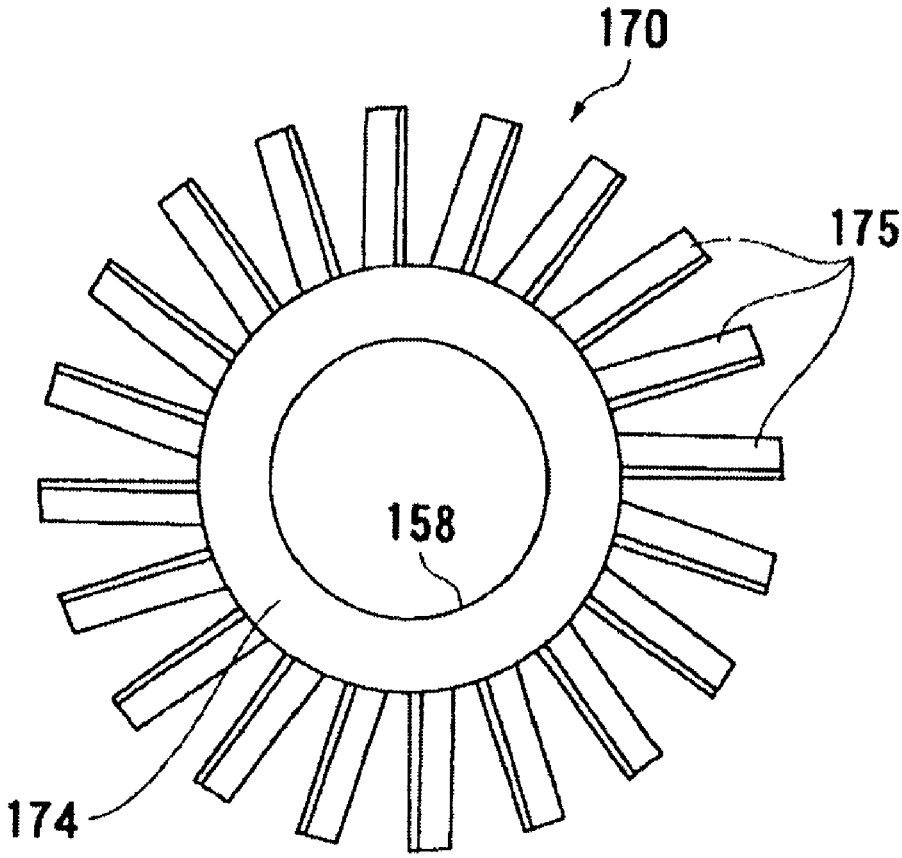
FIG. 14A is a plan view of a turbine blade of the turbo molecular pump shown in FIG. 13.
Figure 14B:
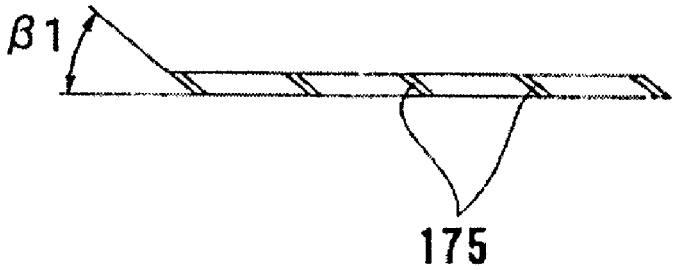
FIG. 14B is a development view in which the turbine blade viewed radially toward a center of the turbine blade is partially developed on the plane.

The structure of the first-stage turbine blade 170 of the turbine blade assembly 173 will be described with reference to FIGS. 14A and 14B. FIG. 14A is a plan view of the turbine blade 170 as viewed from the intake nozzle side (the side of the intake nozzle 123A). FIG. 14B is a development view in which the turbine blade viewed radially toward the center of the turbine blade is partially developed on the plane. The structure of the second-stage and third-stage turbine blades 170 is the same as that of the first-stage turbine blade 170. However, the number of blades, an angle β1 of attachment of blades, and the outer diameter of a hub portion 174 may be changed suitably.

The turbine blade 170 comprises a hub portion 174, and plate-like vanes 175 which are radially attached to the outer peripheral portion of the hub portion 174. The hub portion 174 has a through-hole 158 which allows the rotating shaft 121 (see FIG. 13) to pass therethrough. The vanes 175 are attached to the hub portion 174 such that the vanes 175 have a helix angle twisted from the central axis of the rotating shaft 121 by an angle of β1 (for example, 15 to 40 degrees).

Figure 15A:
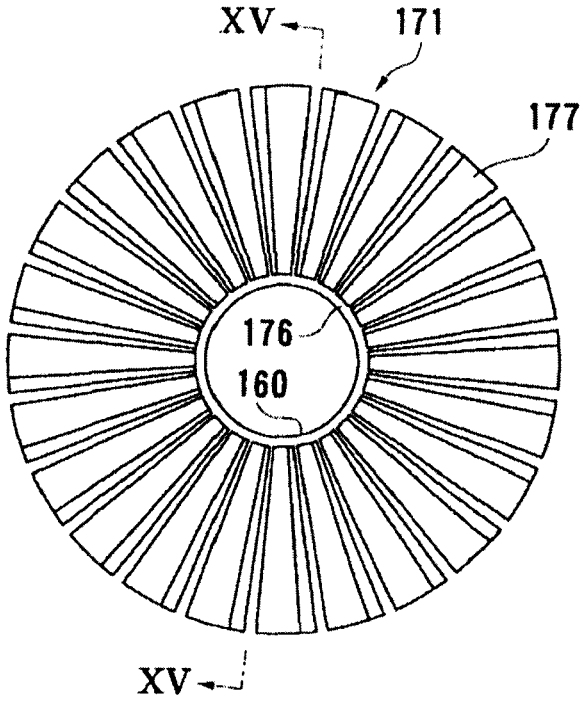
FIG. 15A is a plan view of a first-stage stator blade and a second-stage stator blade of the turbo molecular pump shown in FIG. 13.
Figure 15B:
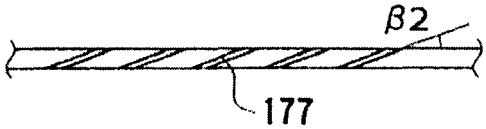
FIG. 15B is a development view in which the turbine blade viewed radially toward a center of the turbine blade is partially developed on the plane.
Figure 15C:
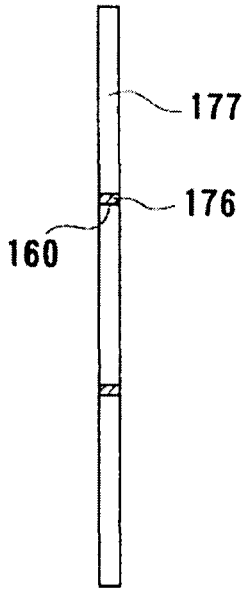
FIG. 15C is a cross-sectional view taken along line XV-XV of FIG. 15A.
Figure 16:
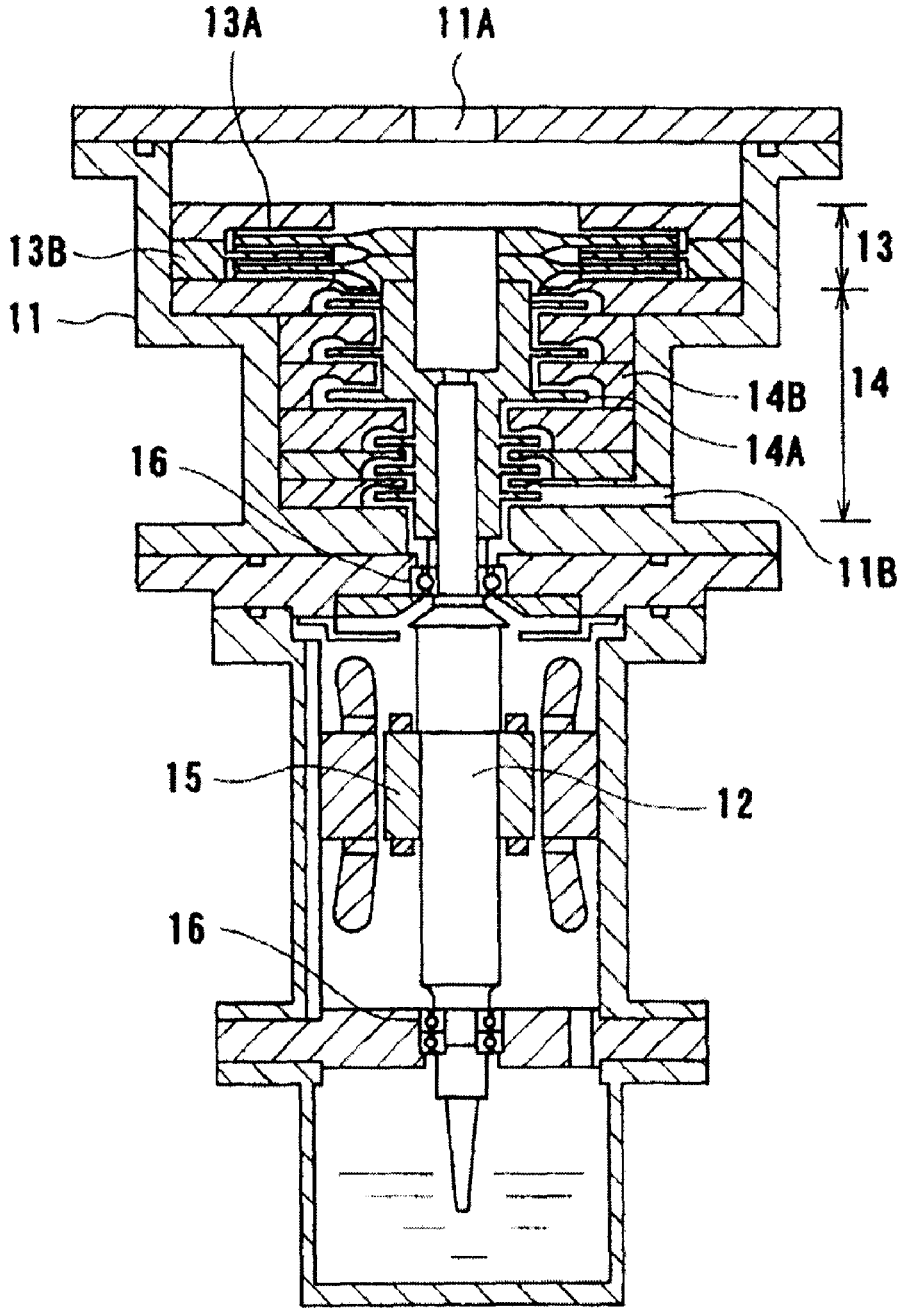
PRIOR ART FIG. 16
FIG. 16 is a vertical cross-sectional view of a conventional turbo vacuum pump.
Figure 17:
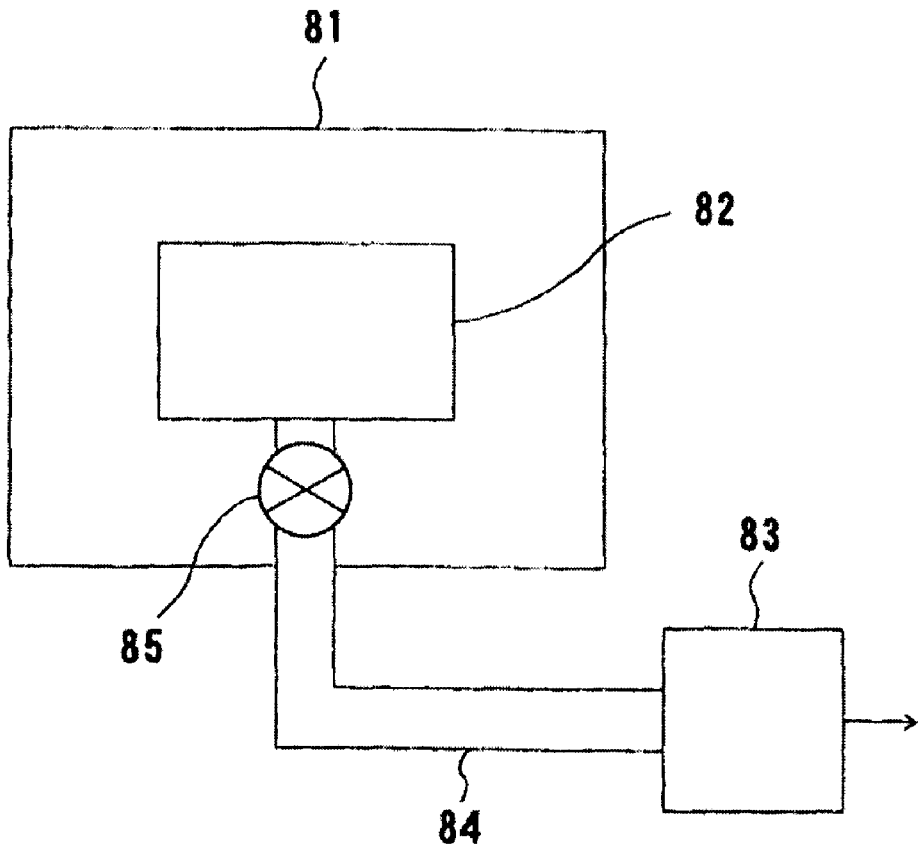
PRIOR ART FIG. 17
FIG. 17 is a schematic view of an example of a conventional semiconductor manufacturing apparatus which uses a vacuum pump.
Figure 18:
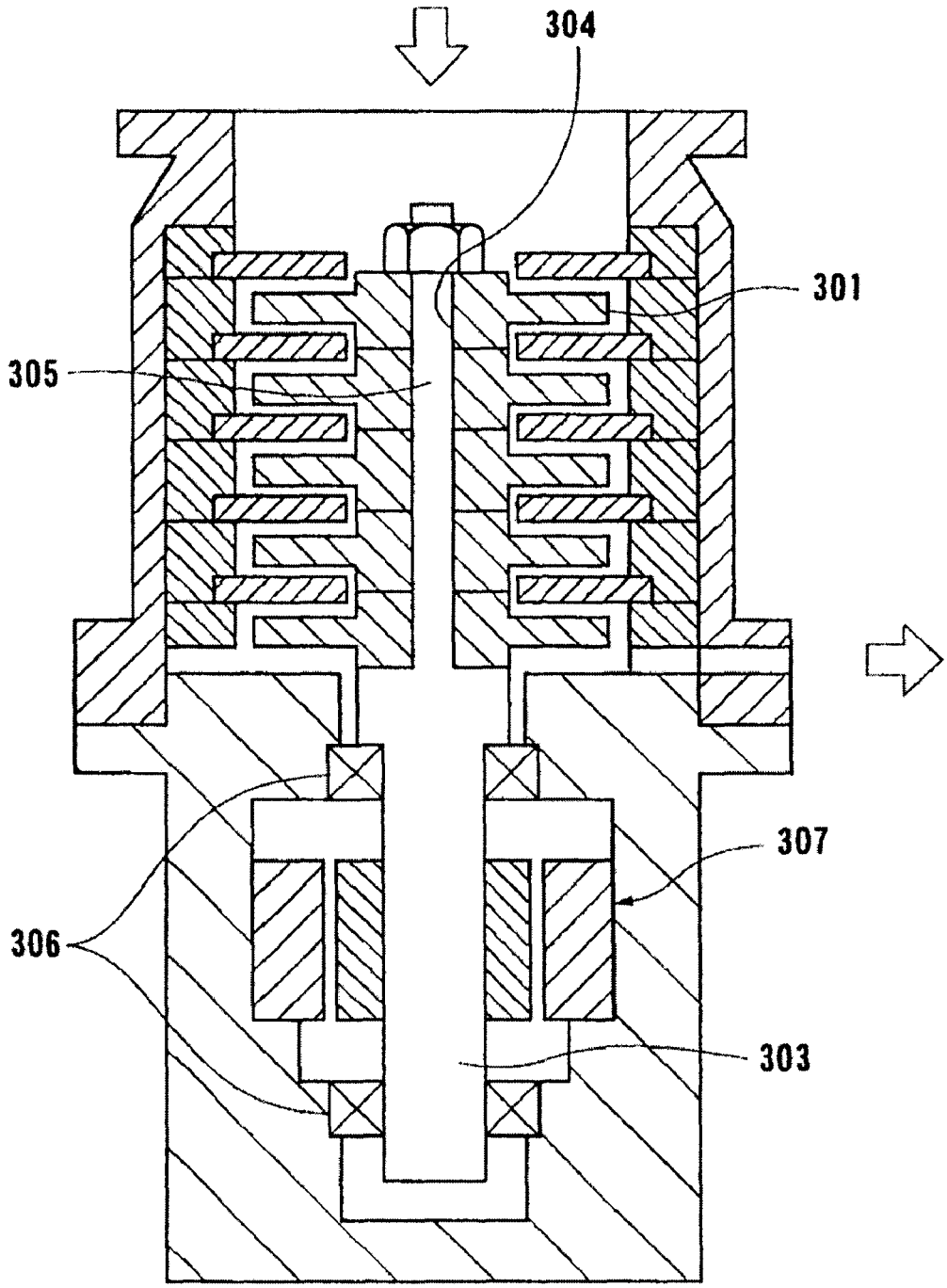
PRIOR ART FIG. 18
FIG. 18 is a vertical cross-sectional view of another conventional turbo vacuum pump.

The structure of the first-stage and second-stage stator blades 171 will be described with reference to FIGS. 13, 15A, 15B and 15C. FIG. 15A is a plan view of the stator blade 171 as viewed from the intake nozzle side (the side of the intake nozzle 123A). FIG. 15B is a development view in which the turbine blade 171 viewed radially toward the center of the turbine blade is partially developed on the plane. FIG. 15C is a cross-sectional view taken along line XV-XV of FIG. 15A.

The stator blade 171 comprises an annular portion 176, and plate-like vanes 177 which are radially attached to the outer peripheral portion of the annular portion 176. The rotating shaft 121 (see FIG. 13) passes through the annular portion 176 with a certain clearance. The vanes 177 are attached to the annular portion 176 such that the vanes 177 have a helix angle twisted from the central axis of the rotating shaft 121 by an angle of β2 (for example, 10 to 30 degrees). The vanes 177 of the first-stage and second-stage stator blades 171 are attached to the inner circumferential surface 181A of the outer circumferential wall 181 of the third-stage stator blade 119.

In the present embodiment also, since the drill hole 122 is formed in the overhanging portion of the rotating shaft 121, the same effect as the second embodiment can be obtained. Further, since the first-stage through third-stage rotor blades are constructed by the turbine blades 170, the degree of vacuum at the intake side can be increased.

Although certain preferred embodiments of the present invention have been shown and described in detail, it should be understood that various changes and modifications may be made therein without departing from the scope of the appended claims.

What is claimed is:

1. A turbo vacuum pump comprising:

a rotating shaft rotatably supported by bearings;

a plurality of rotor blades attached to an overhanging portion of said rotating shaft projecting from one of said bearings in such a state that said rotor blades are stacked in an axial direction of said pump, said overhanging portion of said rotating shaft being a portion which is not supported by said bearing; and a motor rotor attached to said rotating shaft between said bearings for rotating said rotating shaft; wherein said overhanging portion of said rotating shaft has a hole extending from the end of the evacuation side of said rotating shaft to the entirety of said overhanging portion to which said plurality of rotor blades are attached, and said hole formed in said rotating shaft has an open end at said evacuation side of said rotating shaft and a closed end, opposing the open end, located at a lower portion of said overhanging portion of said rotating shaft.

2. A turbo vacuum pump according to claim 1, further comprising:

a plurality of stator blades provided alternately with said rotor blades; and a casing for housing said rotating shaft, a motor including said motor rotor, and said rotor blades, said casing having an intake port for drawing a fluid into said casing and an exhaust port for discharging said fluid to the outside of said casing;

wherein said fluid discharged from the final-stage rotor blade flows in a plane perpendicular to a central axis of said rotating shaft until said fluid discharged from the final-stage rotor blade is discharged from said exhaust port.

3. A turbo vacuum pump according to claim 1, wherein said overhanging portion of said rotating shaft is a portion of said rotating shaft which projects upwardly from an upper bearing of said bearings.

* * * * *